US009405206B2

(12) United States Patent
Kawaguchi et al.

(10) Patent No.: US 9,405,206 B2
(45) Date of Patent: Aug. 2, 2016

(54) ELECTROPHOTOGRAPHIC PHOTOSENSITIVE MEMBER AND METHOD OF PRODUCING THE ELECTROPHOTOGRAPHIC PHOTOSENSITIVE MEMBER, AND PROCESS CARTRIDGE AND ELECTROPHOTOGRAPHIC APPARATUS EACH INCLUDING THE ELECTROPHOTOGRAPHIC PHOTOSENSITIVE MEMBER

(71) Applicant: CANON KABUSHIKI KAISHA, Tokyo (JP)

(72) Inventors: Daisuke Kawaguchi, Susono (JP); Takeshi Murakami, Numazu (JP); Kazumichi Sugiyama, Numazu (JP); Daisuke Tanaka, Yokohoma (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,699

(22) Filed: Dec. 16, 2014

(65) Prior Publication Data

US 2015/0185639 A1 Jul. 2, 2015

(30) Foreign Application Priority Data

Dec. 26, 2013 (JP) ..... 2013-270565
Dec. 3, 2014 (JP) ..... 2014-245137

(51) Int. Cl.
*G03G 5/14* (2006.01)
*G03G 5/07* (2006.01)

(52) U.S. Cl.
CPC ..... *G03G 5/144* (2013.01); *G03G 5/076* (2013.01)

(58) Field of Classification Search
CPC ..... G03G 5/142; G03G 5/144; G03G 5/0525
See application file for complete search history.

(56) References Cited

U.S. PATENT DOCUMENTS

2006/0009563 A1 1/2006 Molaire
2006/0188803 A1 8/2006 Yabuki et al.

(Continued)

FOREIGN PATENT DOCUMENTS

JP 2006-268011 A 10/2006
JP 2008-250082 A 10/2008

(Continued)

OTHER PUBLICATIONS

Yamashita, et al. (eds.), "Crosslinking Agent Handbook", Taiseisha, Ltd., 1981, pp. 536-605.

*Primary Examiner* — Hoa V Le
(74) *Attorney, Agent, or Firm* — Fitzpatrick, Cella, Harper & Scinto

(57) ABSTRACT

Provided is an electrophotographic photosensitive member capable of suppressing a voltage fluctuation and occurrence of a black spot under a high-temperature/high-humidity environment. The electrophotographic photosensitive member includes: a support; a first intermediate layer formed on the support; a second intermediate layer formed on the first intermediate layer; and a photosensitive layer formed on the second intermediate layer, in which the first intermediate layer contains metal oxide particles having a number-average primary particle diameter of from 30 to 450 nm; and the second intermediate layer contains a cured product of a composition containing an electron transport substance having a polymerizable functional group represented by the formula (1) or (2), and having a molecular weight of from 100 to 1,000, and a crosslinking agent having 3 to 6 groups reactive with the polymerizable functional group represented by the formula (1) or (2), and having a molecular weight of from 200 to 1,300.

10 Claims, 1 Drawing Sheet

(56) References Cited

U.S. PATENT DOCUMENTS

| | | | | |
|---|---|---|---|---|
| 2011/0104598 | A1* | 5/2011 | Sekiya | G03G 5/144 430/56 |
| 2013/0137025 | A1 | 5/2013 | Kawahara et al. | |
| 2014/0205940 | A1 | 7/2014 | Tanaka et al. | |
| 2014/0205941 | A1 | 7/2014 | Nishi et al. | |
| 2014/0205946 | A1 | 7/2014 | Sugiyama et al. | |
| 2014/0212800 | A1 | 7/2014 | Miura et al. | |
| 2014/0212807 | A1 | 7/2014 | Miura et al. | |
| 2014/0363759 | A1 | 12/2014 | Watariguchi et al. | |

FOREIGN PATENT DOCUMENTS

| | | | |
|---|---|---|---|
| JP | 2008-299344 | A | 12/2008 |
| JP | 2009-505156 | A | 2/2009 |

* cited by examiner

ELECTROPHOTOGRAPHIC PHOTOSENSITIVE MEMBER AND METHOD OF PRODUCING THE ELECTROPHOTOGRAPHIC PHOTOSENSITIVE MEMBER, AND PROCESS CARTRIDGE AND ELECTROPHOTOGRAPHIC APPARATUS EACH INCLUDING THE ELECTROPHOTOGRAPHIC PHOTOSENSITIVE MEMBER

BACKGROUND OF THE INVENTION

1. Field of the Invention

The present invention relates to an electrophotographic photosensitive member and a method of producing the electrophotographic photosensitive member, and a process cartridge and an electrophotographic apparatus each including the electrophotographic photosensitive member.

2. Description of the Related Art

An electrophotographic photosensitive member containing an organic photoconductive substance (charge generation substance) is known as an electrophotographic photosensitive member to be mounted onto a process cartridge or an electrophotographic apparatus. The electrophotographic photosensitive member generally includes a support and a photosensitive layer (charge generation layer and hole transport layer) formed on the support. In addition, an intermediate layer has been formed between the support and the photosensitive layer for the purpose of suppressing injection of charge from the support to the photosensitive layer to suppress occurrence of an image defect such as fogging. Japanese Patent Application Laid-Open No. 2006-268011 discloses a technology involving incorporating metal oxide particles having small particle diameters into the intermediate layer to suppress the injection of the charge.

In addition, a charge generation substance having an additionally high sensitivity characteristic has been used in recent years. However, as the sensitivity of the charge generation substance rises, an amount of charge to be generated increases and hence the charge is liable to remain in the intermediate layer in an exposed portion. In addition, when image formation is repeatedly performed for a long time period, a voltage fluctuation is liable to become large. Japanese Patent Application Laid-Open No. 2008-250082 and Japanese Patent Application Laid-Open No. 2008-299344 each disclose, as a technology for suppressing such remaining of the charge of the intermediate layer, a technology involving using a laminated structure formed of a layer containing tin oxide-coated titanium oxide and a layer containing an electron transport substance for the intermediate layer to alleviate the voltage fluctuation. Japanese Patent Translation Publication No. 2009-505156 discloses a technology involving using a layer containing a polymer-type electron transport substance on a layer containing metal oxide particles to alleviate the voltage fluctuation.

However, studies made by the inventors of the present invention have found that when an intermediate layer obtained by laminating an intermediate layer containing metal oxide particles having small particle diameters and an intermediate layer containing an electron transport substance is used as the intermediate layer as described above, such a problem as described below arises. That is, the studies have found that the intermediate layer is susceptible to improvement because sufficient suppressing effects may not be obtained on a voltage fluctuation in an exposed portion and occurrence of a black spot under a high-temperature and high-humidity environment.

SUMMARY OF THE INVENTION

That is, the present invention is directed to providing an electrophotographic photosensitive member including a laminated intermediate layer, the electrophotographic photosensitive member having suppressed a voltage fluctuation of an exposed portion and the occurrence of a black spot in repeated image formation under a high-temperature and high-humidity environment, and a method of producing the electrophotographic photosensitive member. The present invention is also directed to providing a process cartridge and an electrophotographic apparatus each including the electrophotographic photosensitive member.

The present invention relates to an electrophotographic photosensitive member, including: a support; a first intermediate layer on the support; a second intermediate layer on the first intermediate layer; and a photosensitive layer on the second intermediate layer, in which: the first intermediate layer includes metal oxide particles having a number-average primary particle diameter of 30 nm or more and 450 nm or less; and the second intermediate layer includes a polymerized product of a composition including an electron transport substance having a polymerizable functional group represented by the following formula (1) or (2), and having a molecular weight of 100 or more and 1,000 or less, and a crosslinking agent having 3 to 6 groups reactive with the polymerizable functional group represented by the following formula (1) or (2), and having a molecular weight of 200 or more and 1,300 or less:

$$-A \quad (1)$$

$$-(-B-)_l C-D \quad (2)$$

in the formulae (1) and (2): at least one of A, B, C, and D represents a group having a polymerizable functional group, the polymerizable functional group is at least one kind of group selected from the group consisting of a hydroxy group, a thiol group, an amino group, and a carboxyl group, and 1 represents 0 or 1.

A represents a carboxyl group, a substituted or unsubstituted alkyl group having 1 to 6 main-chain atoms, a group having 1 to 6 main-chain atoms derived by substituting one of carbon atoms in a main chain of the substituted or unsubstituted alkyl group with an oxygen atom, a group having 1 to 6 main-chain atoms derived by substituting one of the carbon atoms in the main chain of the substituted or unsubstituted alkyl group with a sulfur atom, or a group having 1 to 6 main-chain atoms derived by substituting one of the carbon atoms in the main chain of the substituted or unsubstituted alkyl group with $NR^1$, these groups each have the polymerizable functional group, $R^1$ represents a hydrogen atom or an alkyl group, and a substituent of the substituted alkyl group is an alkyl group having 1 to 6 carbon atoms, a benzyl group, or a phenyl group.

B represents a substituted or unsubstituted alkylene group having 1 to 6 main-chain atoms, a group having 1 to 6 main-chain atoms derived by substituting one of carbon atoms in a main chain of the substituted or unsubstituted alkylene group with an oxygen atom, a group having 1 to 6 main-chain atoms derived by substituting one of the carbon atoms in the main chain of the substituted or unsubstituted alkylene group with a sulfur atom, or a group having 1 to 6 main-chain atoms derived by substituting one of the carbon atoms in the main chain of the substituted or unsubstituted alkylene group with $NR^2$, these groups may each have the polymerizable functional group, $R^2$ represents a hydrogen atom or an alkyl group, and a substituent of the substituted alkylene group is an alkyl group having 1 to 6 carbon atoms, a benzyl group, an alkoxycarbonyl group, or a phenyl group.

C represents a phenylene group, a phenylene group substituted with an alkyl group having 1 to 6 carbon atoms, a nitro-substituted phenylene group, a halogen-substituted phenylene group, or an alkoxy group-substituted phenylene group, and these groups may each have the polymerizable functional group.

D represents a hydrogen atom, an alkyl group having 1 to 6 carbon atoms, or an alkyl group having 1 to 6 main-chain atoms substituted with an alkyl group having 1 to 6 carbon atoms, and these groups may each have the polymerizable functional group.

The present invention also relates to a process cartridge, including: the electrophotographic photosensitive member; and at least one unit selected from the group consisting of a charging unit, a developing unit, and a cleaning unit, the process cartridge integrally supporting the electrophotographic photosensitive member and the at least one unit, the process cartridge being removably mounted onto a main body of an electrophotographic apparatus.

The present invention also relates to an electrophotographic apparatus, including: the electrophotographic photosensitive member; a charging unit; an exposing unit; a developing unit; and a transferring unit.

The present invention also relates to a method of producing an electrophotographic photosensitive member including: a support; a first intermediate layer formed on the support; a second intermediate layer formed on the first intermediate layer; and a photosensitive layer formed on the second intermediate layer, the method including: forming a coat of an application liquid for a first intermediate layer that contains metal oxide particles having a number-average primary particle diameter of 30 nm or more and 450 nm or less; heating the coat to form the first intermediate layer; forming a coat of an application liquid for a second intermediate layer that contains a composition containing an electron transport substance having a polymerizable functional group represented by the formula (1) or (2), and having a molecular weight of 100 or more and 1,000 or less, and a crosslinking agent having 3 to 6 groups reactive with the polymerizable functional group represented by the formula (1) or (2), and having a molecular weight of 200 or more and 1,300 or less; and heating and curing the coat to form the second intermediate layer.

According to the present invention, the electrophotographic photosensitive member that has suppressed a voltage fluctuation of an exposed portion and the occurrence of a black spot in repeated image formation under a high-temperature and high-humidity environment, and the method of producing the electrophotographic photosensitive member can be provided. In addition, according to embodiments of the present invention, the process cartridge and the electrophotographic apparatus each including the electrophotographic photosensitive member can be provided.

Further features of the present invention will become apparent from the following description of exemplary embodiments with reference to the attached drawings.

Figure 1:
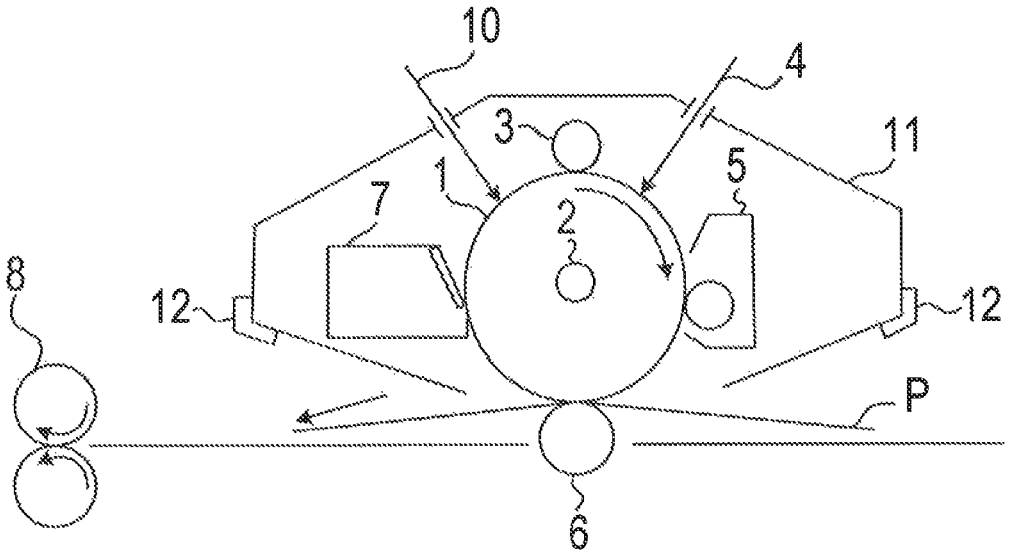
FIG. 1 is a view illustrating an example of the schematic construction of an electrophotographic apparatus including a process cartridge including an electrophotographic photosensitive member.

DESCRIPTION OF THE EMBODIMENTS (First Intermediate Layer)

An electrophotographic photosensitive member of the present invention includes a support, a first intermediate layer formed on the support, a second intermediate layer formed on the first intermediate layer, and a photosensitive layer formed on the second intermediate layer. In addition, the electrophotographic photosensitive member has a feature in that the first intermediate layer contains metal oxide particles having a number-average primary particle diameter of 30 nm or more and 450 nm or less. In addition to the feature, the electrophotographic photosensitive member has a feature in that the second intermediate layer contains a cured product of a composition containing: an electron transport substance having a polymerizable functional group represented by the formula (1) or (2), and having a molecular weight of 100 or more and 1,000 or less; and a crosslinking agent having 3 to 6 groups reactive with the polymerizable functional group, and having a molecular weight of 200 or more and 1,300 or less. The inventors of the present invention have assumed the reason why the electrophotographic photosensitive member having the features is excellent in suppression of a voltage fluctuation of an exposed portion and the occurrence of a black spot due to its repeated use in a high-temperature and high-humidity environment to be as described below.

The use of the metal oxide particles having a number-average primary particle diameter of 30 nm or more and 450 nm or less (also referred to as "small-particle diameter metal oxide particles") in the first intermediate layer can suppress the occurrence of the black spot due to the formation of a local conductive path. However, the small-particle diameter metal oxide particles may be liable to cause the voltage fluctuation of the exposed portion due to the repeated use under a high-temperature and high-humidity environment because the amount of an oxygen-deficient portion per unit mass is large.

A possible reason why the voltage fluctuation occurs is as follows: the oxygen-deficient portion of the small-particle diameter metal oxide particles is oxidized by electrification deterioration in an electrophotographic process and hence the small-particle diameter metal oxide particles are brought into a state of being additionally likely to adsorb moisture. When the oxygen-deficient portion of the small-particle diameter metal oxide particles is oxidized, moisture adsorbs to the oxygen-deficient portion to increase the resistance of the first intermediate layer and charge generated by exposure is liable to remain in the intermediate layer, and hence the voltage fluctuation may occur.

In view of the foregoing, in the present invention, a reducing action on the small-particle diameter metal oxide particles is assumed to be induced by causing an electron-transporting site (electron-localized site) to uniformly exist in the second intermediate layer. In addition, the film uniformity of the second intermediate layer improves and hence the black spot may be suppressed. At this time, in order that a large amount of the electron-localized site may be caused to uniformly exist, a reactive group of the crosslinking agent prefers to be trifunctional to hexafunctional rather than to be difunctional, which may improve the reducing action. Herein, the reactive group refers to a group reactive with the polymerizable functional group represented by the formula (1) or (2). Further, the localization of an electron is enabled by: providing the crosslinking agent with a bonding site obtained by polymerizing a specific electron transport substance and the crosslinking agent; and shortening an interatomic distance between a non-electron-transporting site (electron-nonlocalized site) of the electron transport substance and the bonding site of the crosslinking agent. Probably as a result of the foregoing, the effect of the reducing action can be improved. It is assumed that as a result of the foregoing, the oxidation of the oxygen-deficient portion of the metal oxide particles in the repeated use under a high-temperature and high-humidity environment is suppressed, the increase in resistance of the first intermediate layer is suppressed, and the voltage fluctuation of the exposed portion is suppressed.

(Metal Oxide)

The first intermediate layer of the present invention contains the metal oxide particles having a number-average primary particle diameter of 30 nm or more and 450 nm or less. The number-average primary particle diameter of the metal oxide particles can be calculated by observing a cross-section of the first intermediate layer with a SEM.

The number-average primary particle diameter of the metal oxide particles is more preferably 30 nm or more and 250 nm or less from the viewpoint of the suppression of the black spot. In addition, a method of measuring the number-average primary particle diameter of the metal oxide particles is as described below.

The metal oxide particles in a cross-sectional photograph of the first intermediate layer taken with a scanning electron microscope (SEM) at a certain magnification and a cross-sectional photograph mapped with an element of the metal oxide particles by using an element-analyzing unit such as an X-ray microanalyzer (XMA) included with the SEM are checked against each other. Next, the projected areas of the primary particles of the 100 metal oxide particles are measured, and the diameter of a circle whose area is equal to the measured projected area of each metal oxide particle is determined as the diameter of each metal oxide particle. The number-average primary particle diameter of the metal oxide particles is calculated based on the results and the calculated value is defined as the number-average primary particle diameter.

The metal oxide particles are not particularly limited as long as the particles are used for the purpose of imparting conductivity to the first intermediate layer. Of such particles, zinc oxide particles or titanium oxide particles are preferred from the viewpoint of imparting proper conductivity.

The metal oxide particles may be subjected to surface treatment. Any one of the known methods may be employed as a method for the surface treatment, and a dry method or a wet method is employed.

As a material for the surface treatment, there are given, for example, a silane coupling agent, a titanate-based coupling agent, an aluminum-based coupling agent, and a surface active material as organic compounds. In particular, a coupling agent having an alkoxysilane group, an amino group, an epoxy group, a carboxyl group, a hydroxyl group, or a thiol group is preferred.

The amount of the organic compound with which the surfaces of the metal oxide particles in the first intermediate layer are treated is preferably 0.5 mass % or more and 20 mass % or less with respect to the metal oxide particles from the viewpoints of electrophotographic characteristics.

In addition, a mixture of two or more kinds of particles different from each other in, for example, kind of metal oxide, surface treatment, or particle diameter can be used as the metal oxide particles.

Various additives may be further incorporated into the first intermediate layer for the purposes of, for example, improving the electrical characteristics of the first intermediate layer, improving its film shape stability, and improving image quality. Examples of the additives include: a conductive particle such as carbon black; an electron transport substance such as a quinone compound, a fluorenone compound, an oxadiazole-based compound, a diphenoquinone compound, an anthraquinone compound, a benzophenone compound, a polycyclic condensed compound, or an azo compound; and a metal chelate compound. In particular, a benzophenone compound is preferably used.

The first intermediate layer preferably contains a binder resin. Although any one of the known resins may be used as the binder resin, a curable resin is preferred from the following viewpoint: its elution into an upper layer or a fluctuation in its resistance at the time of the formation of the photosensitive layer is small.

For example, a phenol resin, a polyurethane resin, an epoxy resin, an acrylic resin, a melamine resin, or polyester is preferred as the curable resin. In particular, polyurethane formed of a cured product of a blocked isocyanate compound and polyol is more preferred. Examples of the blocked isocyanate compound include compounds obtained by blocking 2,4-tolylene diisocyanate, 2,6-tolylene diisocyanate, diphenylmethane-4,4'-diisocyanate, hexamethylene diisocyanate (HDI), a HDI-trimethylolpropane adduct form, a HDI-isocyanurate form, and a HDI-biuret form with an oxime. Examples of the oxime include formaldehyde oxime, acetaldoxime, methyl ethyl ketoxime, and cyclohexanone oxime. Examples of the polyol include polyether polyol, polyester polyol, acrylic polyol, epoxy polyol, and fluorine-based polyol.

A solvent to be used for an application liquid for the first intermediate layer may be arbitrarily selected from, for example, alcohol-based, ketone-based, ether-based, ester-based, halogenated hydrocarbon-based, and aromatic solvents. One kind of those solvents may be used alone, or two or more kinds thereof may be used as a mixture.

An organic resin fine particle or a leveling agent may be incorporated into the first intermediate layer as required. A hydrophobic organic resin particle such as a silicone particle or a hydrophilic organic resin particle such as a crosslinking-type polymethacrylate resin (PMMA) particle can be used as the organic resin particle.

The thickness of the first intermediate layer is preferably from about 0.5 to 40 μm, more preferably from 10 to 30 μm.

(Second Intermediate Layer)

The second intermediate layer is a cured film having an electron-transporting ability. The second intermediate layer contains the polymerized product (cured product) of the composition to be described below. The composition contains an electron transport substance having a polymerizable functional group represented by the following formula (1) or (2), and having a molecular weight of 100 or more and 1,000 or less, and a crosslinking agent having 3 to 6 groups reactive with the polymerizable functional group represented by the following formula (1) or (2), and having a molecular weight of 200 or more and 1,300 or less:

$$-A \quad (1)$$

$$-(B)_l C-D \quad (2)$$

in the formulae (1) and (2): at least one of A, B, C, and D represents a group having a polymerizable functional group, the polymerizable functional group includes at least one kind of group selected from the group consisting of a hydroxy group, a thiol group, an amino group, and a carboxyl group, and 1 represents 0 or 1.

A represents a carboxyl group, a substituted or unsubstituted alkyl group having 1 to 6 main-chain atoms, a group having 1 to 6 main-chain atoms derived by substituting one of carbon atoms in a main chain of the substituted or unsubstituted alkyl group with an oxygen atom, a group having 1 to 6 main-chain atoms derived by substituting one of the carbon atoms in the main chain of the substituted or unsubstituted alkyl group with a sulfur atom, or a group having 1 to 6 main-chain atoms derived by substituting one of the carbon atoms in the main chain of the substituted or unsubstituted alkyl group with $NR^1$, these groups each have the polymerizable functional group, $R^1$ represents a hydrogen atom or an alkyl group, and a substituent of the substituted alkyl group includes an alkyl group having 1 to 6 carbon atoms, a benzyl group, or a phenyl group.

B represents a substituted or unsubstituted alkylene group having 1 to 6 main-chain atoms, a group having 1 to 6 main-chain atoms derived by substituting one of carbon atoms in a main chain of the substituted or unsubstituted alkylene group with an oxygen atom, a group having 1 to 6 main-chain atoms derived by substituting one of the carbon atoms in the main chain of the substituted or unsubstituted alkylene group with a sulfur atom, or a group having 1 to 6 main-chain atoms derived by substituting one of the carbon atoms in the main chain of the substituted or unsubstituted alkylene group with $NR^2$, these groups may each have the polymerizable functional group, $R^2$ represents a hydrogen atom or an alkyl group, and a substituent of the substituted alkylene group includes an alkyl group having 1 to 6 carbon atoms, a benzyl group, an alkoxycarbonyl group, or a phenyl group.

C represents a phenylene group, a phenylene group substituted with an alkyl group having 1 to 6 carbon atoms, a nitro-substituted phenylene group, a halogen-substituted phenylene group, or an alkoxy group-substituted phenylene group, and these groups may each have the polymerizable functional group.

D represents a hydrogen atom, an alkyl group having 1 to 6 carbon atoms, or an alkyl group having 1 to 6 main-chain atoms substituted with an alkyl group having 1 to 6 carbon atoms, and these groups may each have the polymerizable functional group.

Examples of the electron transport substance include a quinone compound, an imide compound, a benzimidazole compound, and a cyclopentadienylidene compound.

Specific examples of the electron transport substance are represented in the following formulae (A1) to (A17) but the substance is not limited thereto.

(A1)

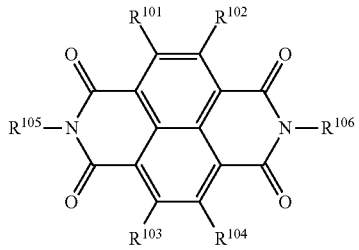

-continued (A2)

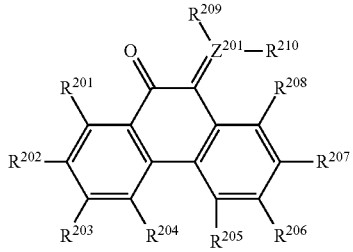

(A3)

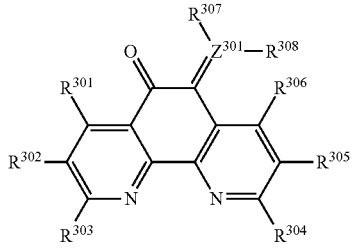

(A4)

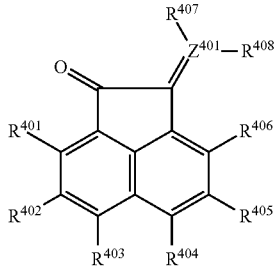

(A5)

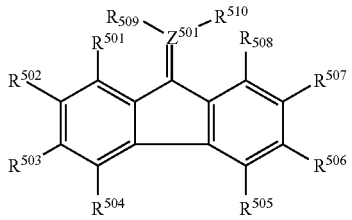

(A6)

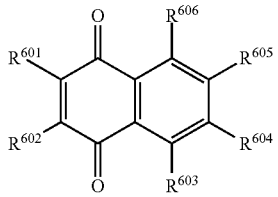

(A7)

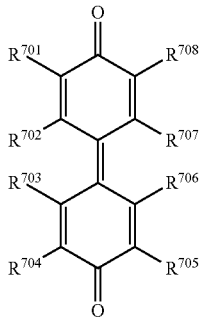

-continued (A8)

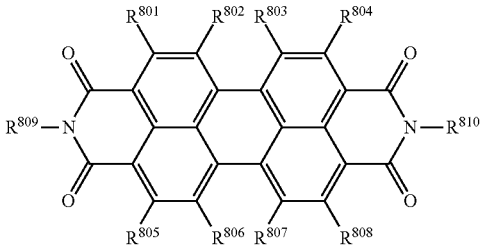

(A9)

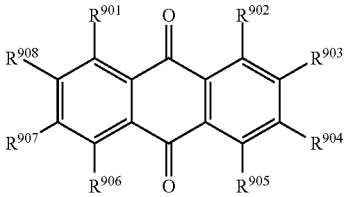

(A10)

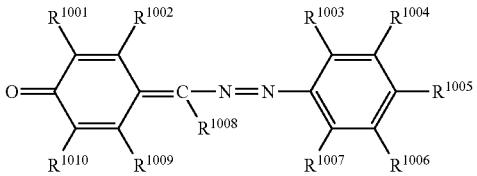

(A11)

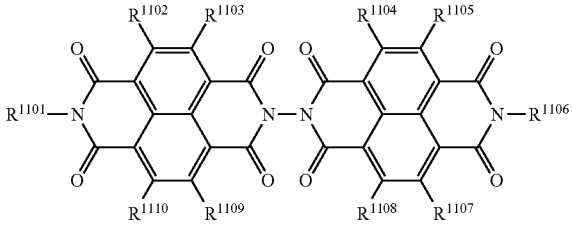

(A12)

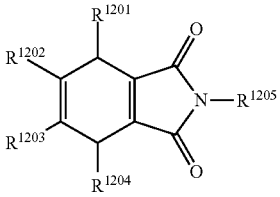

(A13)

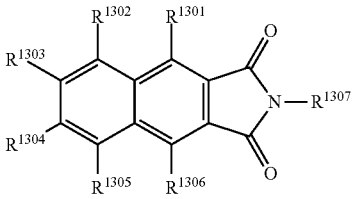

(A14)

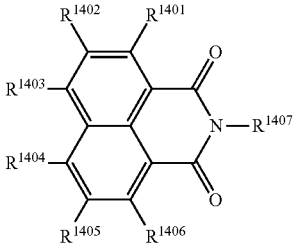

-continued (A15)

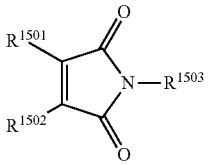

(A16)

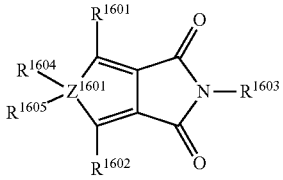

(A17)

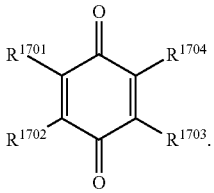

In the formulae (A1) to (A17), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, $R^{901}$ to $R^{908}$, $R^{1001}$ to $R^{1010}$, $R^{1101}$ to $R^{1110}$, $R^{1201}$ to $R^{1205}$, $R^{1301}$ to $R^{1307}$, $R^{1401}$ to $R^{1407}$, $R^{1501}$ to $R^{1503}$, $R^{1601}$ to $R^{1605}$, and $R^{1701}$ to $R^{1704}$ each independently represent a monovalent group represented by the formula (1) or (2), a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. A substituent of the substituted alkyl group is an alkyl group, an aryl group, a halogen atom, or a carbonyl group. Each of a substituent of the substituted aryl group and a substituent of the substituted heterocyclic group is a halogen atom, a nitro group, a cyano group, an alkyl group, a halogen-substituted alkyl group, an alkoxy group, or a carbonyl group. $Z^{201}$, $Z^{301}$, $Z^{401}$, $Z^{501}$, and $Z^{1601}$ each independently represent a carbon atom, a nitrogen atom, or an oxygen atom. $R^{209}$ and $R^{210}$ are absent when $Z^{201}$ represents the oxygen atom, and $R^{210}$ is absent when $Z^{201}$ represents the nitrogen atom. $R^{307}$ and $R^{308}$ are absent when $Z^{301}$ represents the oxygen atom, and $R^{308}$ is absent when $Z^{301}$ represents the nitrogen atom. $R^{407}$ and $R^{408}$ are absent when $Z^{401}$ represents the oxygen atom, and $R^{408}$ is absent when $Z^{401}$ represents the nitrogen atom. $R^{509}$ and $R^{510}$ are absent when $Z^{501}$ represents the oxygen atom, and $R^{510}$ is absent when $Z^{501}$ represents the nitrogen atom. $R^{1604}$ and $R^{1605}$ are absent when $Z^{1601}$ represents the oxygen atom, and $R^{1605}$ is absent when $Z^{1601}$ represents the nitrogen atom. At least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$, at least one of $R^{901}$ to $R^{908}$, at least one of $R^{1001}$ to $R^{1010}$, at least one of $R^{1101}$ to $R^{1110}$, at least one of $R^{1201}$ to $R^{1205}$, at least one of $R^{1301}$ to $R^{1307}$, at least one of $R^{1401}$ to $R^{1407}$, at least one of $R^{1501}$ to $R^{1503}$, at least one of $R^{1601}$ to $R^{1605}$, and at least one of $R^{1701}$ to $R^{1704}$ each represent a group represented by the formula (1) or (2).

Table 1 shows specific examples of the compound represented by the formula (A1).

TABLE 1
| Exemplified Compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A101 | H | H | H | H | 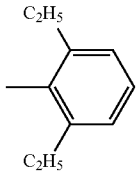 | (1) | 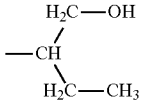 | — | — | — | — | — | — | — |
| A102 | H | H | H | H | 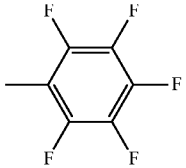 | (1) | —COOH | — | — | — | — | — | — | — |
| A103 | CN | H | H | CN | 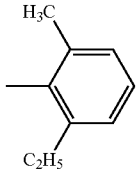 | (2) | — | — | 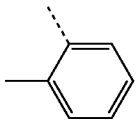 | 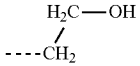 | — | — | — | — |
| A104 | H | $NO_2$ | H | $NO_2$ | 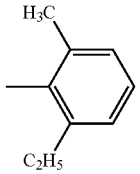 | (1) | 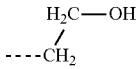 | — | — | — | — | — | — | — |
| A105 | F | H | H | F | (2) | (2) | — | — | 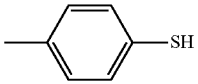 | — | — | — | — | — |

TABLE 1-continued
| Exemplified Compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A106 | H | H | H | H | 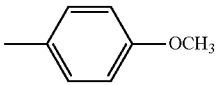 | (2) | — | — | 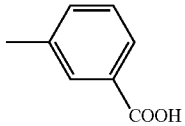 | — | — | — | — | — |
| A107 | H | H | H | H | 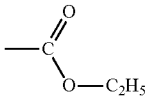 | (2) | — | — | 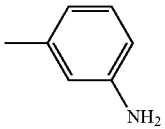 | — | — | — | — | — |
| A108 | H | H | H | H | 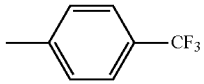 | (2) | — | — | 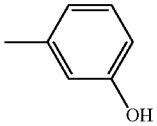 | — | — | — | — | — |
| A109 | H | H | H | H | 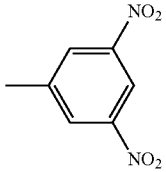 | (2) | — | — | 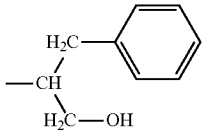 | — | — | — | — | — |
| A110 | H | H | H | H | 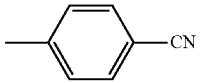 | (2) | — | — | 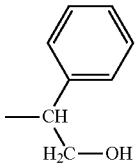 | — | — | — | — | — |
| A111 | H | H | H | H | 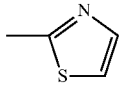 | (1) | 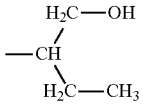 | — | — | — | — | — | — | — |

TABLE 1-continued
| Exemplified Compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A112 | H | H | H | H | 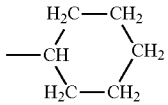 | (1) | 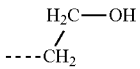 | — | — | — | — | — | — | — |
| A113 | H | H | H | H | 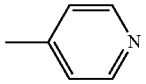 | (2) | — | —$CH_2CH_2$---- | 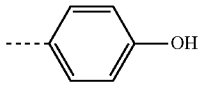 | — | — | — | — | — |
| A114 | H | H | H | H | 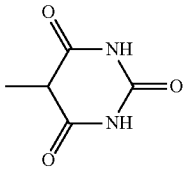 | (2) | — | — | 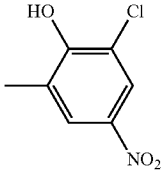 | — | — | — | — | — |
| A115 | H | H | H | H | —$C_2H_4$—O—$C_2H_5$ | (2) | — | — | 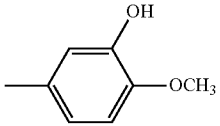 | — | — | — | — | — |
| A116 | H | H | H | H | 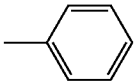 | (1) | —$(CH_2)_5$—OH | — | — | — | — | — | — | — |
| A117 | H | H | H | H | (2) | (2) | — | — | 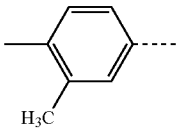 | 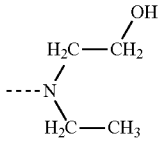 | — | — | — | — |
| A118 | H | H | H | H | (2) | (1)' | — | — | 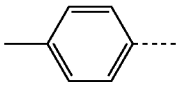 | 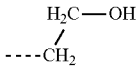 | 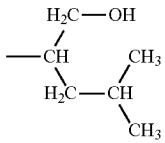 | — | — | — |

TABLE 1-continued
| Exemplified Compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A119 | H | H | H | H | (1) | (1) | 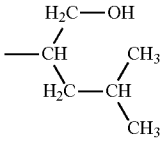 | — | — | — | — | — | — | — |
| A120 | H | H | H | H | (1) | (1)' | 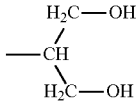 | — | — | — | 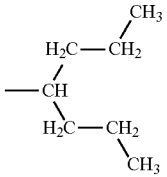 | — | — | — |

Table 2 shows specific examples of the compound represented by the formula (A2).
TABLE 2
| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ |
|---|---|---|---|---|---|---|---|---|---|---|---|
| A201 | H | (1) | H | H | H | H | (2)' | H | — | — | O |
| A202 | H | (2) | H | H | H | H | (1)' | H | — | — | O |
| A203 | H | (2) | H | H | H | H | (1)' | H | — | — | O |
| A204 | $CH_3$ | H | H | H | H | H | H | $CH_3$ | (2) | — | N |
| A205 | H | Cl | H | H | H | H | Cl | H | (2) | — | N |
| A206 | H | H | 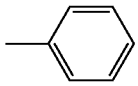 | H | H | 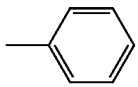 | H | H | (2) | — | N |
| A207 | H | H | 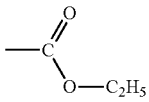 | H | H | 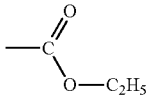 | H | H | (2) | — | N |
| A208 | H | H | (2) | H | H | (2) | H | H | CN | CN | C |
| A209 | H | H | (2) | H | H | (2) | H | H | CN | CN | C |
| Exemplified Compound | (1) A | (2) B | (2) C | (2) D |
|---|---|---|---|---|
| A201 | 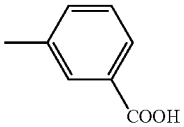 | — | — | — |
| A202 | — | — | 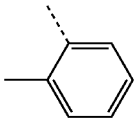 | ----$CH_2$—OH |
| A203 | — | — | 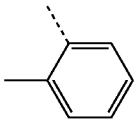 | ----C($H_2$)—COOH |
| A204 | — | — | 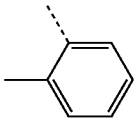 | $H_2C$—OH / ----$CH_2$ |
| A205 | — | — | 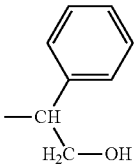 | — |
| A206 | — | — | 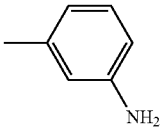 | — |
| A207 | — | — | 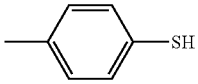 | — |

TABLE 2-continued

| | | | | |
|---|---|---|---|---|
| A208 | — | — | 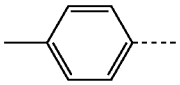 | ----$CH_2$—OH |
| A209 | — | —$CH_2CH_2$--- | 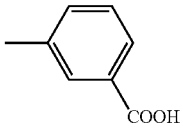 | — |

| Exemplified Compound | (1)' A | (2)' B | (2)' C | (2)' D |
|---|---|---|---|---|
| A201 | — | — | 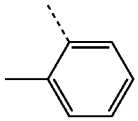 | ----$CH_2$—OH |
| A202 | —$(CH_2)_5$—OH | — | — | — |
| A203 | ----C—COOH $H_2$ | — | — | — |
| A204 | — | — | — | — |
| A205 | — | — | — | — |
| A206 | — | — | — | — |
| A207 | — | — | — | — |
| A208 | ----$CH_2$—OH | — | — | — |
| A209 | — | — | — | — |

Table 3 shows specific examples of the compound represented by the formula (A3).

TABLE 3

| Exemplified Compound | $R^{301}$ | $R^{302}$ | $R^{303}$ | $R^{304}$ | $R^{305}$ | $R^{306}$ | $R^{307}$ | $R^{308}$ | $Z^{301}$ | (1) A |
|---|---|---|---|---|---|---|---|---|---|---|
| A301 | H | (1) | H | H | (2)' | H | — | — | O | $H_2C$—OH / —CH \ $H_2C$—$CH_3$ |
| A302 | H | (2) | H | H | (1)' | H | — | — | O | — |
| A303 | H | (2) | H | H | (1)' | H | — | — | O | — |
| A304 | H | H | H | H | H | H | (2) | — | N | — |
| A305 | H | Cl | H | H | Cl | H | (2) | — | N | — |
| A306 | H | H | 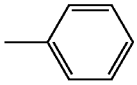 | 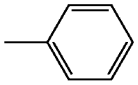 | H | H | (2) | — | N | — |
| A307 | H | H | 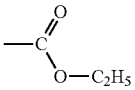 | 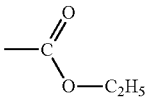 | H | H | (2) | — | N | — |
| A308 | H | H | (2) | (2) | H | H | CN | CN | C | — |
| A309 | H | H | (2) | (2) | H | H | CN | CN | C | — |

TABLE 3-continued
| Exemplified | (2) | | | (1)' | (2)' | | |
|---|---|---|---|---|---|---|---|
| Compound | B | C | D | A | B | C | D |
| A301 | — | — | — | — | — | 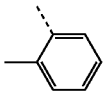 | ----$CH_2$—OH |
| A302 | — | 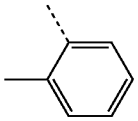 | ----$CH_2$—OH | —$(CH_2)_5$—OH | — | — | — |
| A303 | — | 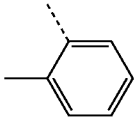 | ----C($H_2$)—COOH | ----C($H_2$)—COOH | — | — | — |
| A304 | — | 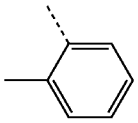 | $H_2C$—OH / ----$CH_2$ | — | — | — | — |
| A305 | — | 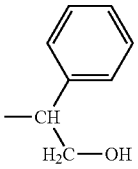 | — | — | — | — | — |
| A306 | — | 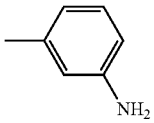 | — | — | — | — | — |
| A307 | — | 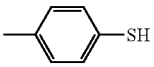 | — | — | — | — | — |
| A308 | — | 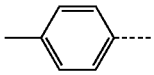 | ----$CH_2$—OH | — | — | — | — |
| A309 | —$CH_2CH_2$--- | 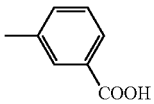 | — | — | — | — | — |
Table 4 shows specific examples of the compound represented by the formula (A4).
TABLE 4
| Exemplified Compound | $R^{401}$ | $R^{402}$ | $R^{403}$ | $R^{404}$ | $R^{405}$ | $R^{406}$ | $R^{407}$ | $R^{408}$ | $Z^{401}$ | (1) A |
|---|---|---|---|---|---|---|---|---|---|---|
| A401 | H | Cl | H | H | Cl | H | (2) | — | N | — |
| A402 | H | H | 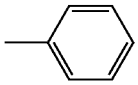 | 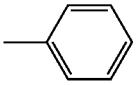 | H | H | (2) | — | N | — |

TABLE 4-continued
| | | | | | | | | | | |
|---|---|---|---|---|---|---|---|---|---|---|
| A403 | H | H | —C(=O)—O—$C_2H_5$ | —C(=O)—O—$C_2H_5$ | H | H | (2) | — | N | — |
| A405 | H | H | (2) | (2) | H | H | — | — | O | — |
| A408 | H | H | (2) | (2) | H | H | — | — | O | — |
| A409 | H | H | (2) | (2) | H | H | — | — | O | — |
| A410 | H | H | (1) | (1) | H | H | CN | CN | C | $H_2C$—OH / —$CH_2$ |
| A411 | H | H | (1) | (1) | H | H | CN | CN | C | COOH |
| A412 | H | H | (1) | (1) | H | H | CN | CN | C | $NH_2$ |
| Exemplified Compound | (2) B | (2) C | (2) D |
|---|---|---|---|
| A401 | — | 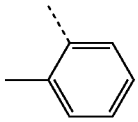 | $H_2C$—OH / ----$CH_2$ |
| A402 | — | 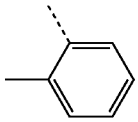 | $H_2C$—OH / ----$CH_2$ |
| A403 | — | 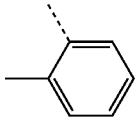 | $H_2C$—OH / ----$CH_2$ |
| A405 | — | 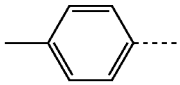 | ----$CH_2$—OH |
| A408 | — | 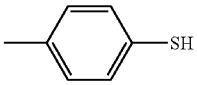 | — |
| A409 | —$CH_2CH_2$--- | 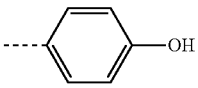 | — |
| A410 | — | — | — |
| A411 | — | — | — |
| A412 | — | — | — |

Table 5 shows specific examples of the compound represented by the formula (A5).
TABLE 5
| Exemplified Compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | (1) A |
|---|---|---|---|---|---|---|---|---|---|---|---|---|
| A501 | H | (2) | H | H | H | H | (2) | H | — | — | O | — |
| A502 | H | (2) | H | H | H | H | (2) | H | — | — | O | — |
| A503 | H | (2) | H | H | H | H | (2) | H | — | — | O | — |
| A504 | H | (2) | H | H | H | H | (2) | H | 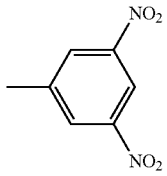 | — | N | — |
| A505 | H | H | H | H | H | H | H | H | (1) | — | N | 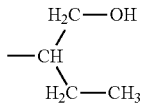 |
| A506 | $CH_3$ | H | H | H | H | H | H | $CH_3$ | (2) | — | N | — |
| A507 | H | (1) | H | H | H | H | (1) | H | CN | CN | C | $NH_2$ |
| A508 | H | H | (2) | H | H | (2) | H | H | CN | CN | C | — |
| A509 | H | (2) | H | H | H | H | (2) | H | CN | CN | C | — |
| Exemplified Compound | (2) B | (2) C | (2) D |
|---|---|---|---|
| A501 | — | 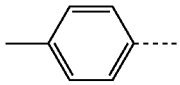 | ----$CH_2$—OH |
| A502 | — | 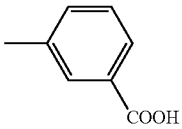 | — |
| A503 | — | 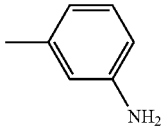 | — |
| A504 | — | 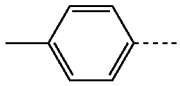 | ----$CH_2$—OH |
| A505 | — | — | — |
| A506 | — | 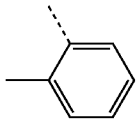 | 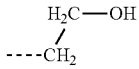 |
| A507 | — | — | — |
| A508 | — | 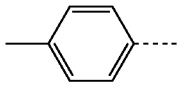 | ----$CH_2$—OH |
| A509 | —$CH_2CH_2$--- | 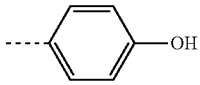 | — |

Table 6 shows specific examples of the compound represented by the formula (A6).

TABLE 6

| Exemplified Compound | $R^{601}$ | $R^{602}$ | $R^{603}$ | $R^{604}$ | $R^{605}$ | $R^{606}$ | (1) A | (2) B | (2) C | (2) D |
|---|---|---|---|---|---|---|---|---|---|---|
| A601 | (2) | H | H | H | H | H | — | — | 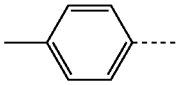 | ----$CH_2$—OH |
| A602 | (2) | H | H | H | H | H | — | — | 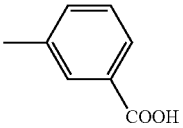 | — |
| A603 | (2) | H | H | H | H | H | — | — | 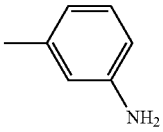 | — |
| A604 | (2) | H | H | H | H | H | — | — | 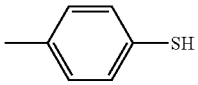 | — |
| A605 | (2) | H | H | H | H | H | — | —$CH_2CH_2$--- | 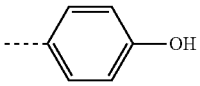 | — |
| A606 | (1) | H | H | H | H | H | 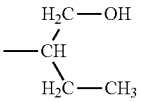 | — | — | — |
| A607 | CN | CN | (1) | H | H | H | $NH_2$ | — | — | — |
| A608 | (2) | (2) | H | H | H | H | — | — | 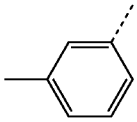 | ----$CH_2$—OH |
| A609 | (1) | (1) | H | H | H | H | 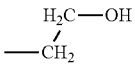 | — | — | — |
| A610 | (1) | (1) | H | H | H | H | COOH | — | — | — |

Table 7 shows specific examples of the compound represented by the formula (A7).

TABLE 7

| Exemplified Compound | $R^{701}$ | $R^{702}$ | $R^{703}$ | $R^{704}$ | $R^{705}$ | $R^{706}$ | $R^{707}$ | $R^{708}$ | (1) A | (2) B | (2) C |
|---|---|---|---|---|---|---|---|---|---|---|---|
| A701 | (1) | H | H | H | (2)' | H | H | H | 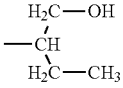 | — | — |

TABLE 7-continued
| | | | | | | | | | | | |
|---|---|---|---|---|---|---|---|---|---|---|---|
| A702 | (2) | H | H | H | (1)' | H | H | H | — | — | 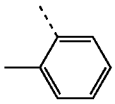 |
| A703 | (2) | H | H | H | (1)' | H | H | H | — | — | 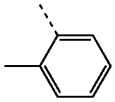 |
| A704 | (2) | H | H | H | H | H | H | H | — | — | 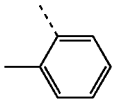 |
| A705 | (2) | H | H | H | H | H | H | H | — | — | 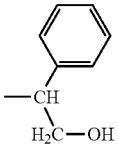 |
| A706 | (2) | H | H | H | H | H | H | H | — | — | 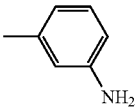 |
| A707 | (2) | H | H | H | H | H | H | H | — | — | 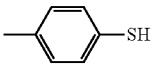 |
| A708 | (2) | H | H | H | (2) | H | H | H | — | — | 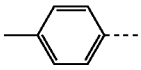 |
| A709 | (2) | H | H | H | (2) | H | H | H | — | $—CH_2CH_2----$ | 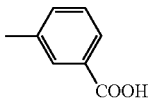 |
| Exemplified Compound | (2) D | (1)' A | (2)' B | (2)' C | (2)' D |
|---|---|---|---|---|---|
| A701 | — | — | — | 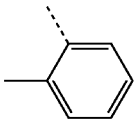 | $----CH_2—OH$ |
| A702 | $----CH_2—OH$ | $—(CH_2)_5—OH$ | — | — | — |
| A703 | $----C(H_2)—COOH$ | $----C(H_2)—COOH$ | — | — | — |
| A704 | $H_2C—OH$ / $----CH_2$ | — | — | — | — |
| A705 | — | — | — | — | — |
| A706 | — | — | — | — | — |
| A707 | — | — | — | — | — |
| A708 | $----CH_2—OH$ | — | — | — | — |
| A709 | — | — | — | — | — |

Table 8 shows specific examples of the compound represented by the formula (A8).

TABLE 8

| Exemplified Compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | (1) A | (2) B | (2) C |
|---|---|---|---|---|---|---|---|---|---|---|---|---|---|
| A801 | H | H | H | H | H | H | H | H | (1) | (1)' | $H_2C-OH$ / $-CH$ \ $H_2C-CH_3$ | — | — |
| A802 | H | H | H | H | H | H | H | H | (2) | (1)' | — | — | 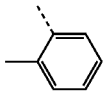 |
| A803 | H | H | H | H | H | H | H | H | (2) | (1)' | — | — | 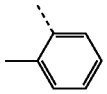 |
| A804 | H | H | H | H | H | H | H | H | (2) | (2)' | — | — | 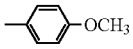 |
| A805 | H | Cl | Cl | H | H | Cl | Cl | H | 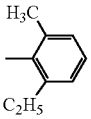 | (1) | $H_2C-OH$ / $-CH$ \ $H_2C-CH_3$ | — | — |
| A806 | H | H | H | H | H | H | H | H | 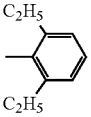 | (2) | — | — | 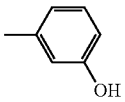 |
| A807 | H | H | H | H | H | H | H | H | 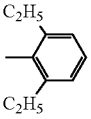 | (2) | — | — | 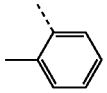 |
| A808 | H | H | H | H | H | H | H | H | (2) | (2) | — | $-CH_2CH_2-$ | 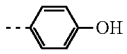 |
| A809 | H | H | H | H | H | H | H | H | (2) | (1)' | — | — | 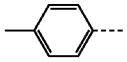 |
| A810 | H | H | H | H | H | H | H | H | (1) | (1) | $H_2C-OH$ / $-CH$ \ $H_2C-CH$ / $CH_3$ \ $CH_3$ | — | — |
| A811 | H | H | H | H | H | H | H | H | (1) | (1)' | $H_2C-OH$ / $-CH$ \ $H_2C-OH$ | — | — |

| Exemplified Compound | (2)' D | (1)' A | (2)' B | (2)' C | (2)' D |
|---|---|---|---|---|---|
| A801 | — | $-(CH_2)_5-OH$ | — | — | — |
| A802 | $----CH_2-OH$ | $-(CH_2)_5-OH$ | — | — | — |

TABLE 8-continued

| | | | | | |
|---|---|---|---|---|---|
| A803 | -----C(H$_2$)—COOH | --C(H$_2$)-COOH | — | — | — |
| A804 | — | — | — | 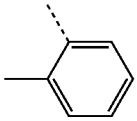 | ----$CH_2$—OH |
| A805 | — | — | — | — | — |
| A806 | — | — | — | — | — |
| A807 | $H_2C$—OH / -----$CH_2$ | — | — | — | — |
| A808 | — | — | — | — | — |
| A809 | $H_2C$—OH / ----$CH_2$ | $H_2C$-OH / -CH(-$H_2C$-CH(-$CH_3$)-$CH_3$) | — | — | — |
| A810 | — | — | — | — | — |
| A811 | — | -CH(-$H_2C$-$CH_2$-$CH_3$)-CH(-$H_2C$-$CH_2$-$CH_3$) | — | — | — |

Table 9 shows specific examples of the compound represented by the formula (A9).

TABLE 9

| Exemplified Compound | $R^{901}$ | $R^{902}$ | $R^{903}$ | $R^{904}$ | $R^{905}$ | $R^{906}$ | $R^{907}$ | $R^{908}$ | (1) A | (2) B | (2) C | (2) D |
|---|---|---|---|---|---|---|---|---|---|---|---|---|
| A901 | (1) | H | H | H | H | H | H | H | —$CH_2$—OH | — | — | — |
| A902 | (1) | H | H | H | H | H | H | H | —($CH_2$)$_2$—OH | — | — | — |
| A903 | (1) | H | H | H | (1)' | H | H | H | — | —$CH_2CH_2$---- | --- 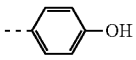 | — |
| A904 | (1) | H | H | H | (1)' | H | H | H | —($CH_2$)$_2$—OH | — | — | — |
| A905 | H | H | H | H | H | H | H | (2) | — | — | 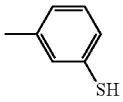 | — |
| A906 | H | H | H | H | H | H | H | (2) | — | — | 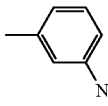 | — |
| A907 | H | H | H | H | H | H | H | (2) | — | — | 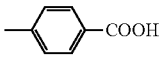 | — |
| A908 | H | CN | H | H | H | H | CN | (2) | — | — | 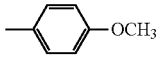 | — |

TABLE 9-continued
| | | | | | | | | | | | | |
|---|---|---|---|---|---|---|---|---|---|---|---|---|
| A909 | (2) | H | H | H | (2) | H | H | H | — | — | 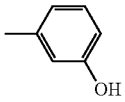 | — |
| A910 | (1) | H | H | (2)' | H | H | H | H | $-(CH_2)_2-OH$ | — | — | — |
| A911 | H | (2)' | H | H | H | H | H | (1) | $-(CH_2)_6-OH$ | — | — | — |
| Exemplified Compound | (1)' A | (2)' B | (2)' C | (2)' D |
|---|---|---|---|---|
| A901 | — | — | — | — |
| A902 | — | — | — | — |
| A903 | $----CH_2-COOH$ | — | — | — |
| A904 | — | — | 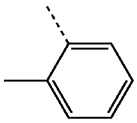 | $----CH_2-OH$ |
| A905 | — | — | — | — |
| A906 | — | — | — | — |
| A907 | — | — | — | — |
| A908 | — | — | — | — |
| A909 | — | — | — | — |
| A910 | — | — | 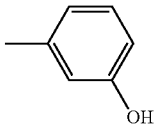 | — |
| A911 | — | — | 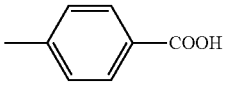 | — |
Table 10 shows specific examples of the compound represented by the formula (A10).
TABLE 10
| Exemplified Compound | $R^{1001}$ | $R^{1002}$ | $R^{1003}$ | $R^{1004}$ | $R^{1005}$ | $R^{1006}$ | $R^{1007}$ | $R^{1008}$ | $R^{1009}$ | $R^{1010}$ | (1) A | (2) B | (2) C | (2) D |
|---|---|---|---|---|---|---|---|---|---|---|---|---|---|---|
| A1001 | $-C(CH_3)_3$ | H | H | H | H | (1) | H | H | H | $-C(CH_3)_3$ | $-CH_2-OH$ | — | — | — |
| A1002 | $-C(CH_3)_3$ | H | H | H | H | (2) | H | H | H | $-C(CH_3)_3$ | — | — | 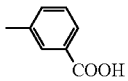 | — |
| A1003 | $-C(CH_3)_3$ | H | H | H | H | (2) | H | H | H | $-C(CH_3)_3$ | — | $-CH_2CH_2-$ | 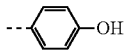 | — |

TABLE 10-continued

| | | | | | | | | | | | | | | |
|---|---|---|---|---|---|---|---|---|---|---|---|---|---|---|
| A1004 | $-C(CH_3)_3$ | H | H | H | H | (2) | H | H | H | $-C(CH_3)_3$ | — | — | $-C_6H_4-NH_2$ | — |
| A1005 | $-C(CH_3)_3$ | H | H | H | H | (2) | H | H | H | $-C(CH_3)_3$ | — | — | $-C_6H_4-SH$ | — |
| A1006 | $-C_6H_5$ | H | H | H | H | (1) | H | H | H | $-C_6H_5$ | $-CH_2-OH$ | — | — | — |
| A1007 | $-C_6H_5$ | H | H | H | H | (2) | H | H | H | $-C_6H_5$ | — | — | $-C_6H_4-COOH$ | — |
| A1008 | $-C_6H_5$ | H | H | H | H | (2) | H | H | H | $-C_6H_5$ | — | $-CH_2CH_2-$ | $-C_6H_4-OH$ | — |
| A1009 | $-C_6H_5$ | H | H | H | H | (2) | H | H | H | $-C_6H_5$ | — | — | $-C_6H_4-NH_2$ | — |
| A1010 | $-C_6H_5$ | H | H | H | H | (2) | H | H | H | $-C_6H_5$ | — | — | $-C_6H_4-SH$ | — |

Table 11 shows specific examples of the compound represented by the formula (A11).

TABLE 11

| Exemplified Compound | $R^{1101}$ | $R^{1102}$ | $R^{1103}$ | $R^{1104}$ | $R^{1105}$ | $R^{1106}$ | $R^{1107}$ | $R^{1108}$ | $R^{1109}$ | $R^{1110}$ | (1) A | (2) B |
|---|---|---|---|---|---|---|---|---|---|---|---|---|
| A1101 | (1) | H | H | H | H | (1) | H | H | H | H | $-CH(C_2H_5)(CH_2-OH)$ | — |
| A1102 | (2) | H | H | H | H | (1)' | H | H | H | H | — | — |
| A1103 | (2) | H | H | H | H | (1)' | H | H | H | H | — | — |
| A1104 | (2) | H | H | H | H | (2)' | H | H | H | H | — | — |
| A1105 | $-C_6H_3(CH_3)(C_2H_5)$ | H | Cl | Cl | H | (1) | H | Cl | Cl | H | $-CH(CH_2-OH)(CH_2-CH_3)$ | — |
| A1106 | $-C_6H_3(C_2H_5)(C_2H_5)$ | H | H | H | H | (2) | H | H | H | H | — | — |
| A1107 | $-C_6H_3(C_2H_5)(C_2H_5)$ | H | H | H | H | (2) | H | H | H | H | — | — |
| A1108 | (2) | H | H | H | H | (2) | H | H | H | H | — | $-CH_2CH_2-$ |
| A1109 | (2) | H | H | H | H | (1)' | H | H | H | H | — | — |

TABLE 11-continued
| | | | | | | | | | | | | |
|---|---|---|---|---|---|---|---|---|---|---|---|---|
| A1110 | (1) | H | H | H | H | (1) | H | H | H | H | $H_2C—OH$<br>$-CH$ $CH_3$<br>$H_2C-CH$<br>$CH_3$ | — |
| A1111 | (1) | H | H | H | H | (1)' | H | H | H | H | $H_2C-OH$<br>$-CH$<br>$H_2C-OH$ | — |
| Exemplified Compound | (2) C | (2) D | (1)' A | (2)' B | (2)' C | (2)' D |
|---|---|---|---|---|---|---|
| A1101 | — | — | — | — | — | — |
| A1102 | 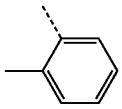 | $----CH_2—OH$ | $-(CH_2)_5-OH$ | — | — | — |
| A1103 | 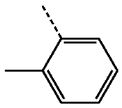 | $----C(H_2)—COOH$ | $--C(H_2)-COOH$ | — | — | — |
| A1104 | 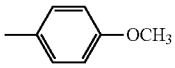 | — | — | — | 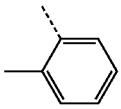 | $----CH_2—OH$ |
| A1105 | — | — | — | — | — | — |
| A1106 | 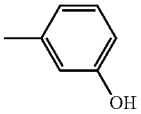 | — | — | — | — | — |
| A1107 | 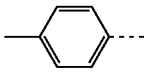 | $----C(H_2)—COOH$ | — | — | — | — |
| A1108 | 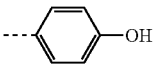 | — | — | — | — | — |
| A1109 | 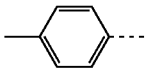 | $H_2C—OH$<br>$----CH_2$ | $H_2C-OH$<br>$-CH$ $CH_3$<br>$H_2C-CH$<br>$CH_3$ | — | — | — |
| A1110 | — | — | — | — | — | — |
| A1111 | — | — | $CH_3$<br>$H_2C-CH_2$<br>$-CH$<br>$H_2C-CH_2$<br>$CH_3$ | — | — | — |

Table 12 shows specific examples of the compound represented by the formula (A12).

TABLE 12

| Exemplified Compound | $R^{1201}$ | $R^{1202}$ | $R^{1203}$ | $R^{1204}$ | $R^{1205}$ | (1) A | (2) B | (2) C | (2) D |
|---|---|---|---|---|---|---|---|---|---|
| A1201 | H | $NO_2$ | H | H | (2) | — | — | 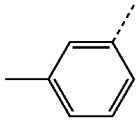 | ----$CH_2$—OH |
| A1202 | H | F | H | H | (2) | — | — | 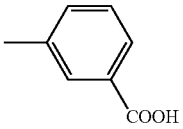 | — |
| A1203 | H | CN | H | H | (2) | — | — | 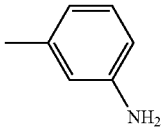 | — |
| A1204 | H | 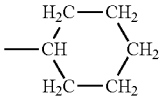 | H | H | (2) | — | — | 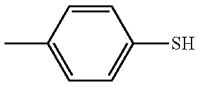 | — |
| A1205 | H | H | H | H | (2) | — | —$CH_2CH_2$--- | 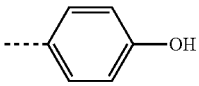 | — |
| A1206 | H | H | H | H | (1) | 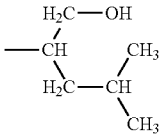 | — | — | — |
| A1207 | H | H | H | H | (1) | 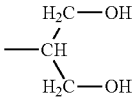 | — | — | — |
| A1208 | H | (1) | (1) | H | H | 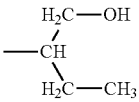 | — | — | — |
| A1209 | H | (1) | (1) | H | H | COOH | — | — | — |

Table 13 shows specific examples of the compound represented by the formula (A13).

TABLE 13

| Exemplified Compound | $R^{1301}$ | $R^{1302}$ | $R^{1303}$ | $R^{1304}$ | $R^{1305}$ | $R^{1306}$ | $R^{1307}$ | (1) A | (2) B | (2) C | (2) D |
|---|---|---|---|---|---|---|---|---|---|---|---|
| A1301 | H | H | H | H | H | H | (2) | — | — | 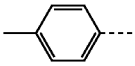 | --$CH_2$–OH |

TABLE 13-continued

| Exemplified Compound | $R^{1301}$ | $R^{1302}$ | $R^{1303}$ | $R^{1304}$ | $R^{1305}$ | $R^{1306}$ | $R^{1307}$ | (1) A | (2) B | (2) C | (2) D |
|---|---|---|---|---|---|---|---|---|---|---|---|
| A1302 | H | H | $NO_2$ | H | H | H | (2) | — | — | 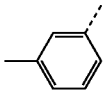 | --$CH_2$–OH |
| A1303 | H | H | F | H | H | H | (2) | — | — | 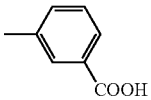 | — |
| A1304 | H | H | CN | H | H | H | (2) | — | — | 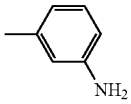 | — |
| A1305 | H | H | 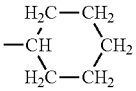 | H | H | H | (2) | — | — | 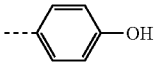 | — |
| A1306 | H | H | H | H | H | H | (2) | — | –$CH_2CH_2$-- | 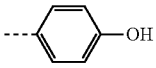 | — |
| A1307 | H | H | —$C_6H_{13}$ | H | H | H | (1) | $NH_2$ | — | — | — |
| A1308 | H | H | (2) | (2) | H | H | H | — | — | 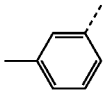 | --$CH_2$–OH |
| A1309 | H | H | (1) | (1) | H | H | H | 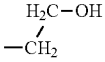 | — | — | — |

Table 14 shows specific examples of the compound represented by the formula (A14).

TABLE 14

| Exemplified Compound | $R^{1401}$ | $R^{1402}$ | $R^{1403}$ | $R^{1404}$ | $R^{1405}$ | $R^{1406}$ | $R^{1407}$ | (1) A | (2) B | (2) C | (2) D |
|---|---|---|---|---|---|---|---|---|---|---|---|
| A1401 | H | H | H | H | H | H | (2) | — | — | 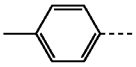 | --$CH_2$–OH |
| A1402 | H | H | $NO_2$ | H | H | H | (2) | — | — | 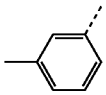 | --$CH_2$–OH |
| A1403 | H | H | F | H | H | H | (2) | — | — | 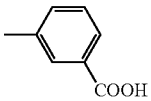 | — |
| A1404 | H | H | CN | H | H | H | (2) | — | — | 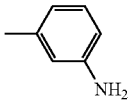 | — |
| A1405 | H | H | 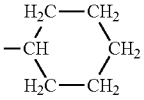 | H | H | H | (2) | — | — | 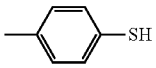 | — |

TABLE 14-continued
| Exemplified Compound | $R^{1401}$ | $R^{1402}$ | $R^{1403}$ | $R^{1404}$ | $R^{1405}$ | $R^{1406}$ | $R^{1407}$ | (1) A | (2) B | (2) C | (2) D |
|---|---|---|---|---|---|---|---|---|---|---|---|
| A1406 | H | H | H | H | H | H | (2) | — | $-CH_2CH_2-$ | 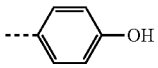 | — |
| A1407 | H | H | H | H | H | H | (1) | $H_2C-OH$ / $-CH_2$ | — | — | — |
| A1408 | H | H | (2) | (2) | H | H | H | — | — | 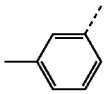 | $-CH_2-OH$ |
| A1409 | H | H | (1) | (1) | H | H | H | $H_2C-OH$ / $-CH$ \ $H_2C-CH_3$ | — | — | — |
| A1410 | H | H | (1) | (1) | H | H | H | COOH | — | — | — |
Table 15 shows specific examples of the compound represented by the formula (A15).
TABLE 15
| Exemplified Compound | $R^{1501}$ | $R^{1502}$ | $R^{1503}$ | (1) A | (2) B | (2) C | (2) D |
|---|---|---|---|---|---|---|---|
| A1501 | H | H | (2) | — | — | 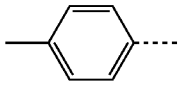 | $-CH_2-OH$ |
| A1502 | $NO_2$ | H | (2) | — | — | 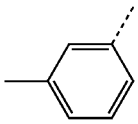 | $-CH_2-OH$ |
| A1503 | F | H | (2) | — | — | 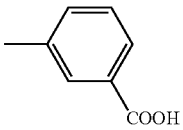 | — |
| A1504 | 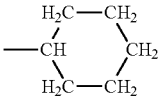 | H | (2) | — | — | 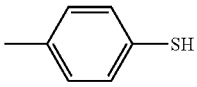 | — |
| A1505 | H | H | (1) | 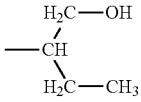 | — | — | — |
| A1506 | H | H | (1) | 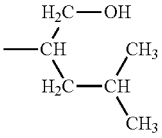 | — | — | — |
| A1507 | $-C_6H_{13}$ | H | (1) | $NH_2$ | — | — | — |

TABLE 15-continued
| Exemplified Compound | $R^{1501}$ | $R^{1502}$ | $R^{1503}$ | (1) A | (2) B | (2) C | (2) D |
|---|---|---|---|---|---|---|---|
| A1508 | (2) | (2) | H | — | — | 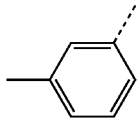 | ----$CH_2$—OH |
| A1509 | (1) | (1) | H | $H_2C$—OH / —$CH_2$ | — | — | — |
Table 16 shows specific examples of the compound represented by the formula (A16).
TABLE 16
| Exemplified Compound | $R^{1601}$ | $R^{1602}$ | $R^{1603}$ | $R^{1604}$ | $R^{1605}$ | $Z^{1601}$ | (1) A | (2) B | (2) C | (2) D |
|---|---|---|---|---|---|---|---|---|---|---|
| A1601 | H | H | (2) | H | H | C | — | — | 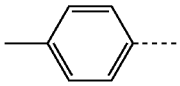 | ----$CH_2$—OH |
| A1602 | CN | H | (2) | H | H | C | — | — | 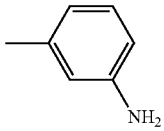 | — |
| A1603 | H | H | (2) | H | H | C | — | —$CH_2CH_2$--- | 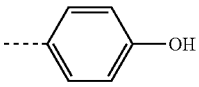 | — |
| A1604 | H | H | (1) | — | — | O | $H_2C$—OH / —CH / $H_2C$—$CH_3$ | — | — | — |
| A1605 | H | H | (1) | — | — | O | $H_2C$—OH / —CH / $H_2C$—OH | — | — | — |
| A1606 | —$C_6H_{13}$ | H | (1) | H | — | N | $NH_2$ | — | — | — |
| A1607 | (2) | (2) | H | H | H | C | — | — | 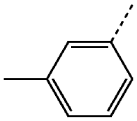 | ----$CH_2$—OH |
| A1608 | (1) | (1) | H | H | H | C | COOH | — | — | — |

Table 17 shows specific examples of the compound represented by the formula (A17).
TABLE 17
| Exemplified Compound | $R^{1701}$ | $R^{1702}$ | $R^{1703}$ | $R^{1704}$ | (1) A | (2) B | (2) C | (2) D |
|---|---|---|---|---|---|---|---|---|
| A1701 | (2) | H | H | H | — | — | 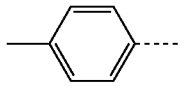 | ----$CH_2$—OH |
| A1702 | (2) | H | H | $NO_2$ | — | — | 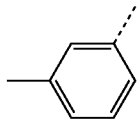 | ----$CH_2$—OH |
| A1703 | (2) | H | H | H | — | — | 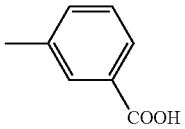 | — |
| A1704 | (2) | H | H | H | — | — | 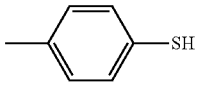 | — |
| A1705 | (2) | H | H | H | — | —$CH_2CH_2$--- | 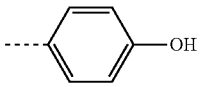 | — |
| A1706 | (1) | H | H | H | 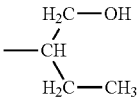 | — | — | — |
| A1707 | (1) | F | H | H | COOH | — | — | — |
| A1708 | (1) | CN | H | H | COOH | — | — | — |
| A1709 | (1) | 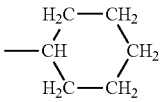 | H | H | COOH | — | — | — |
| A1710 | (1) | H | 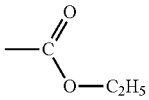 | H | COOH | — | — | — |
| A1711 | (2) | H | (2) | H | — | — | 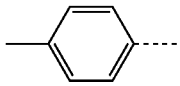 | ----$CH_2$—OH |
| A1712 | (2) | $NO_2$ | (2) | $NO_2$ | — | — | 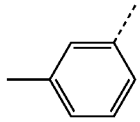 | ----$CH_2$—OH |
| A1713 | (2) | H | (2) | H | — | — | 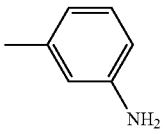 | — |

A derivative (derivative of the electron transport substance) having a structure represented by any one of the formulae (A2) to (A6), (A9), (A12) to (A15), and (A17) can be purchased from Tokyo Chemical Industry Co., Ltd., Sigma-Aldrich Japan K.K., or Johnson Matthey Japan Incorporated. A derivative having a structure represented by the formula (A1) can be synthesized by a reaction between naphthalenetetracarboxylic dianhydride and a monoamine derivative that can be purchased from Tokyo Chemical Industry Co., Ltd., Sigma-Aldrich Japan K.K., or Johnson Matthey Japan Incorporated. A derivative having a structure represented by the formula (A7) can be synthesized by using a phenol derivative that can be purchased from Tokyo Chemical Industry Co., Ltd. or Sigma-Aldrich Japan K.K. as a raw material. A derivative having a structure represented by the formula (A8) can be synthesized by a reaction between perylenetetracarboxylic dianhydride and a monoamine derivative that can be purchased from Tokyo Chemical Industry Co., Ltd. or Johnson Matthey Japan Incorporated. A derivative having a structure represented by the formula (A10) can be synthesized by subjecting a compound that can be purchased from Tokyo Chemical Industry Co., Ltd. or Sigma-Aldrich Japan K.K. to oxidation in an organic solvent (such as chloroform) using an appropriate oxidizing agent (such as potassium permanganate). A derivative having a structure represented by the formula (A11) can be synthesized by a reaction among a naphthalenetetracarboxylic dianhydride, a monoamine derivative, and hydrazine that can be purchased from Tokyo Chemical Industry Co., Ltd. or Sigma-Aldrich Japan K.K. A derivative having a structure represented by the formula (A16) can be synthesized according to a known method that has been employed in synthesizing a general carboxylic acid imide.

The compound represented by any one of the formulae (A1) to (A17) has a polymerizable functional group that can polymerize with a crosslinking agent (a hydroxy group, a thiol group, an amino group, a carboxyl group, or a methoxy group). Two methods are each available as a method of introducing any such polymerizable functional group into the derivative having a structure represented by any one of the formulae (A1) to (A17). A first method involves directly introducing the polymerizable functional group into the derivative having a structure represented by any one of the formulae (A1) to (A17). A second method involves introducing a structure having the polymerizable functional group or a functional group that can serve as a precursor of the polymerizable functional group into the derivative having a structure represented by any one of the formulae (A1) to (A17). Available as the second method is a method involving introducing a functional group-containing aryl group by means of a cross-coupling reaction based on a halide of the derivative having a structure represented by any one of the formulae (A1) to (A17), the reaction involving using a palladium catalyst and a base. Also available is a method involving introducing a functional group-containing alkyl group by means of a cross-coupling reaction based on the halide of the derivative having a structure represented by any one of the formulae (A1) to (A17), the reaction involving using an $FeCl_3$ catalyst and a base. Also available is a method involving subjecting the halide of the derivative having a structure represented by any one of the formulae (A1) to (A17) to lithiation, and causing an epoxy compound or $CO_2$ to act on the resultant to introduce a hydroxyalkyl group or a carboxyl group.

(Crosslinking Agent)

Next, the crosslinking agent is described.

A compound that polymerizes or crosslinks with the polymerizable functional group of the electron transport substance and a thermoplastic resin having a polymerizable functional group to be described later can be used as the crosslinking agent. Specifically, for example, a compound described in the "Crosslinking Agent Handbook" edited by Shinzo Yamashita and Tosuke Kaneko, and published by TAISEISHA LTD. (1981) can be used.

The crosslinking agent of the present invention has a molecular weight of 200 or more and 1,300 or less, and has 3 to 6 groups reactive with the polymerizable functional group of the electron transport substance.

Preferred examples of the crosslinking agent include an isocyanate compound having an isocyanate group or a blocked isocyanate group and an amine compound having an N-methylol group or an alkyl-etherified N-methylol group.

Examples of the isocyanate compound include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate such as tolylene diisocyanate, hexamethylene diisocyanate, dicyclohexylmethane diisocyanate, naphthalenediisocyanatodiphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate. Of those, an isocyanurate modified product and an adduct modified product are more preferred.

The blocked isocyanate group is a group having a structure represented by —$NHCOX^1$ (where $X^1$ represents a protective group). Although $X^1$ may represent any protective group as long as the protective group can be introduced into an isocyanate group, $X^1$ more preferably represents a group represented by any one of the following formulae (H1) to (H6).

(H1)

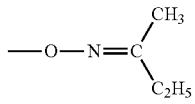

(H2)

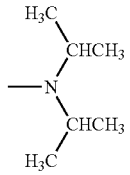

(H3)

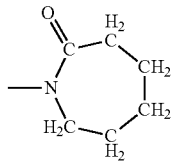

(H4)

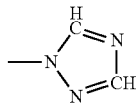

(H5)

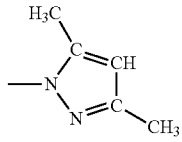

-continued
(H6)
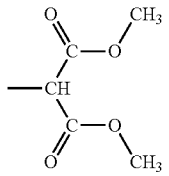
Specific examples of the isocyanate compound are shown below.
(B1)
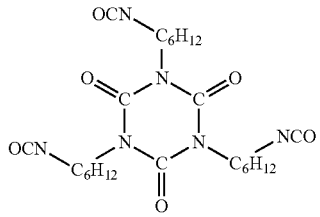
(B2)
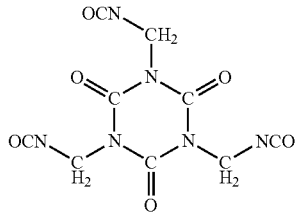
(B3)
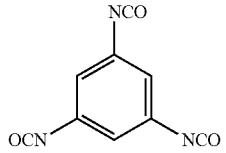
(B4)
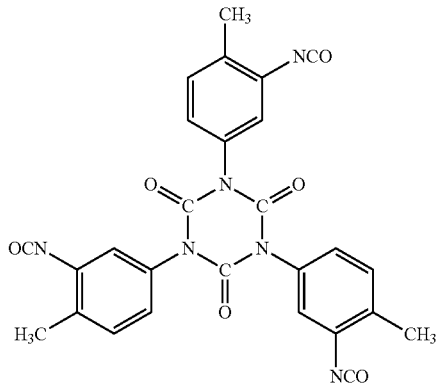
-continued
(B5)
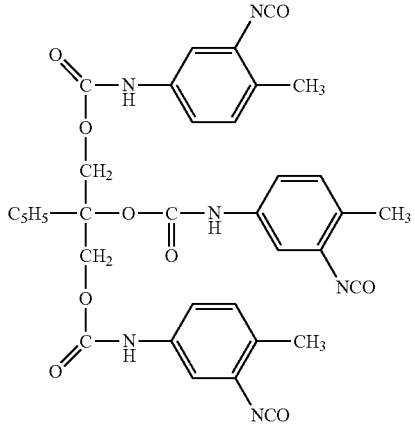
(B6)
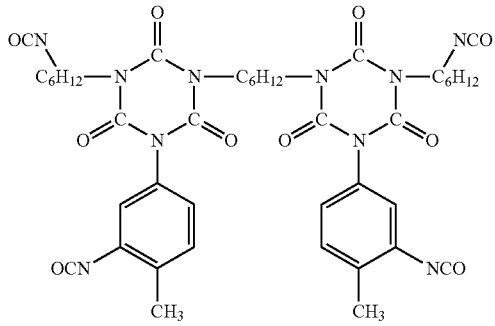
(B7)
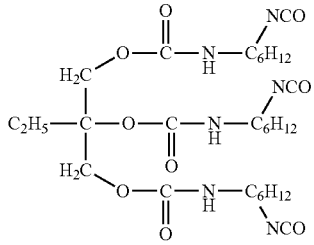
(B8)
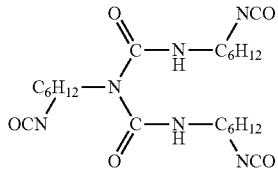
(B9)
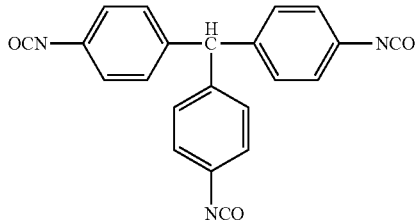

-continued (B10)

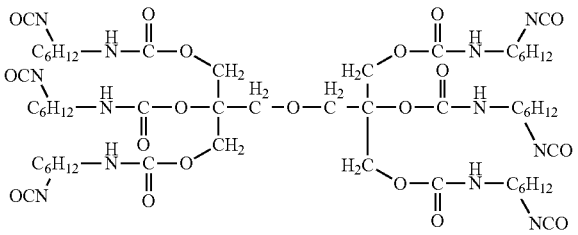

Preferred examples of the amine compound include a compound represented by any one of the following formulae (C1) to (C5) and an oligomer of the compound represented by any one of the following formulae (C1) to (C5).

(C1)

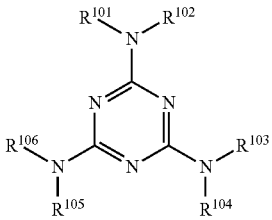

(C2)

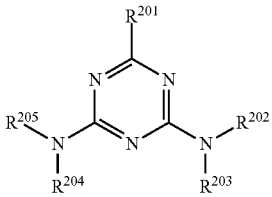

(C3)

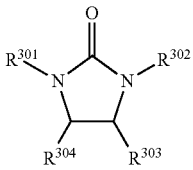

(C4)

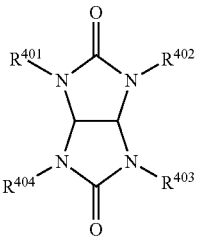

(C5)

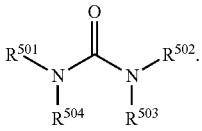

In the formulae (C1) to (C5), $R^{101}$ to $R^{106}$, $R^{202}$ to $R^{205}$, $R^{301}$ to $R^{304}$, $R^{401}$ to $R^{404}$, and $R^{501}$ to $R^{504}$ each independently represent a hydrogen atom, a hydroxy group, an acyl group, or a monovalent group represented by $—CH_2—OR^1$. At least one of $R^{101}$ to $R^{106}$, at least one of $R^{202}$ to $R^{205}$, at least one of $R^{301}$ to $R^{304}$, at least one of $R^{401}$ to $R^{404}$, and at least one of $R^{501}$ to $R^{504}$ each represent a monovalent group represented by $—CH_2—OR^1$. $R^1$ represents a hydrogen atom or an alkyl group having 1 or more and 10 or less carbon atoms. $R^{201}$ represents an aryl group, an alkyl group-substituted aryl group, a cycloalkyl group, or an alkyl group-substituted cycloalkyl group.

Specific examples of the compound represented by any one of the formulae (C1) to (C5) are shown below.

(C1-1)

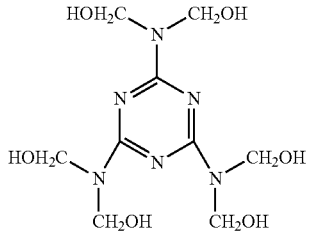

(C1-2)

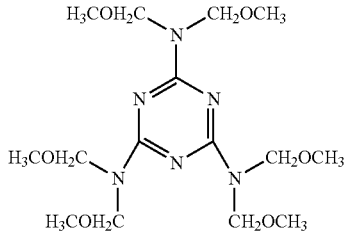

(C1-3)

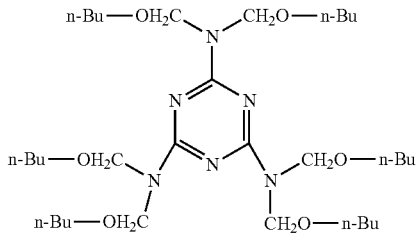

(C1-4)

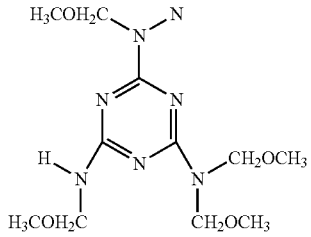

(C1-5)

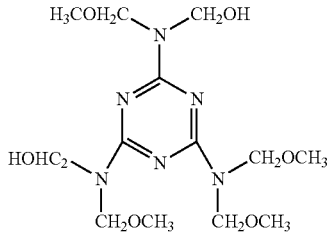

-continued (C1-6)

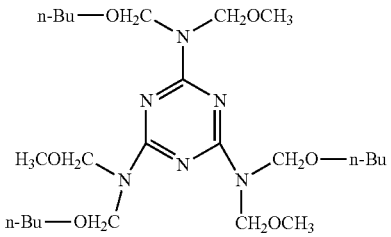

(C2-1)

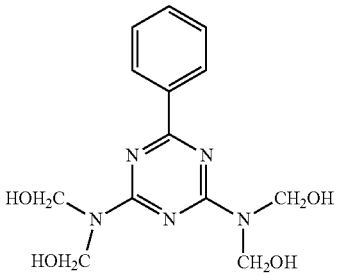

(C2-2)

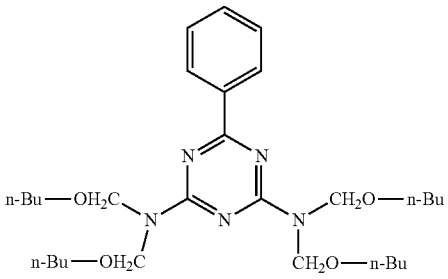

(C2-3)

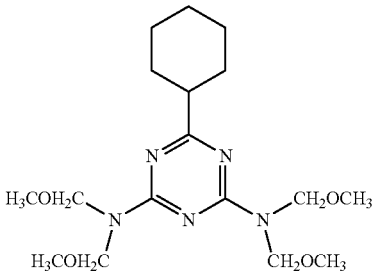

(C3-1)

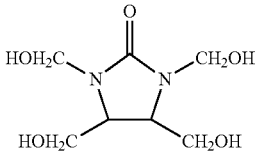

(C3-2)

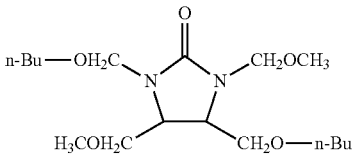

(C3-3)

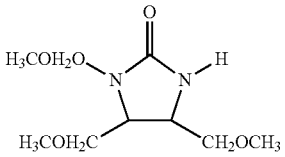

-continued (C4-1)

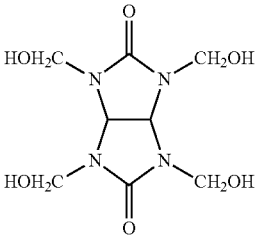

(C4-2)

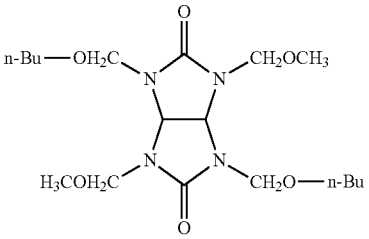

(C4-3)

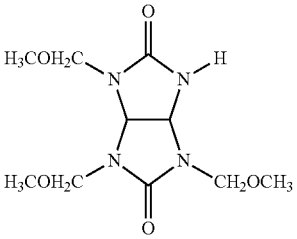

(C5-1)

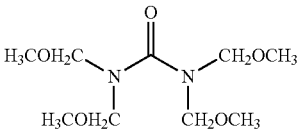

(C5-2)

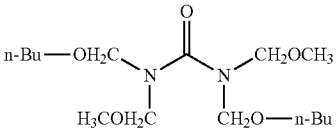

(C5-3)

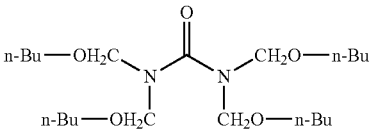

A compound that can be generally purchased as the compound represented by the formula (C1) is exemplified by SUPER MELAMI No. 90 (manufactured by NOF CORPORATION), SUPER BECKAMINE (trade name) TD-139-60, L-105-60, L127-60, L110-60, J-820-60, or G-821-60 (manufactured by DIC Corporation), U-VAN 2020 (Mitsui Chemicals, Inc.), Sumitex Resin M-3 (Sumitomo Chemical Company), or NIKALAC MW-30, MW-390, or MX-750LM (manufactured by NIPPON CARBIDE INDUSTRIES CO., INC.). A compound that can be generally purchased as the compound represented by the formula (C2) is exemplified by SUPER BECKAMINE (trade name) L-148-55, 13-535, L-145-60, or TD-126 (manufactured by DIC Corporation) or NIKALAC BL-60 or BX-4000 (manufactured by NIPPON CARBIDE INDUSTRIES CO., INC.). A compound that can be generally purchased as the compound represented by the formula (C3) is exemplified by NIKALAC MX-280 (manufactured by NIPPON CARBIDE INDUSTRIES CO., INC.).

A compound that can be generally purchased as the compound represented by the formula (C4) is exemplified by NIKALAC MX-270 (manufactured by NIPPON CARBIDE INDUSTRIES CO., INC.). A compound that can be generally purchased as the compound represented by the formula (C5) is exemplified by NIKALAC MX-290 (manufactured by NIPPON CARBIDE INDUSTRIES CO., INC.).

A ratio between the molecular weights of the electron transport substance and the crosslinking agent preferably falls within the range of from 3/20 to 50/20. When the ratio falls within the range, the electron-transporting site uniformly exists in the film and hence the bias of the reducing action on the metal oxide particles may reduce. The ratio more preferably falls within the range of from 12/20 to 28/20. Further, a mass ratio between the electron transport substance having a polymerizable functional group and crosslinking agent in the composition of the second intermediate layer falls within the range of preferably from 1/9 to 9/1, more preferably from 3/7 to 7/3 from the viewpoint of the uniformity of its film structure.

In addition, the composition of the second intermediate layer preferably further contains a thermoplastic resin having a polymerizable functional group. The thermoplastic resin having a polymerizable functional group is preferably a thermoplastic resin having a structural unit represented by the following formula (D).

(D)

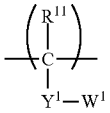

(In the formula (D), $R^{11}$ represents a hydrogen atom or an alkyl group, $Y^1$ represents a single bond, an alkylene group, or a phenylene group, and $W^1$ represents a hydroxy group, a thiol group, an amino group, or a carboxyl group.)

Examples of the thermoplastic resin having a structural unit represented by the formula (D) include an acetal resin, a polyolefin resin, a polyester resin, a polyether resin, and a polyamide resin. Those resins each further have a characteristic structure represented below in addition to the structural unit represented by the formula (D). The characteristic structures are represented in the following formulae (E-1) to (E-5). The formula (E-1) represents the structural unit of the acetal resin, the formula (E-2) represents the structural unit of the polyolefin resin, the formula (E-3) represents the structural unit of the polyester resin, the formula (E-4) represents the structural unit of the polyether resin, and the formula (E-5) represents the structural unit of the polyamide resin.

(E-1)

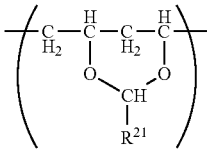

(E-2)

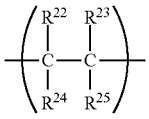

-continued (E-3)

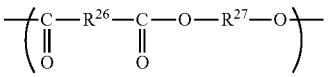

(E-4)

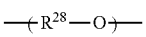

(E-5)

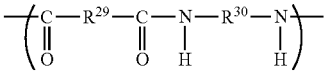

In the formulae (E-1) to (E-5), $R^{21}$ to $R^{25}$ each independently represent a substituted or unsubstituted alkyl group, or a substituted or unsubstituted aryl group, and $R^{26}$ to $R^{30}$ each independently represent a substituted or unsubstituted alkylene group, or a substituted or unsubstituted arylene group. For example, when $R^{21}$ in the formula (E-1) represents $C_3H_7$, the resin is a butyral resin.

The resin having a structural unit represented by the formula (D) (hereinafter sometimes referred to as "resin D") is obtained by polymerizing a monomer having a polymerizable functional group that can be purchased from, for example, Sigma-Aldrich Japan K.K. or Tokyo Chemical Industry Co., Ltd.

In addition, the resin can be generally purchased as a resin. Examples of the resin that can be purchased include: a polyether polyol-based resin such as AQD-457 or AQD-473 manufactured by Nippon Polyurethane Industry Co., Ltd., or SANNIX GP-400 or GP-700 manufactured by Sanyo Chemical Industries, Ltd.; a polyester polyol-based resin such as PHTHALKYD W2343 manufactured by Hitachi Chemical Co., Ltd., WATERSOL S-118 or CD-520 or BECKOLITE M-6402-50 or M-6201-40IM manufactured by DIC Corporation, HARIDIP WH-1188 manufactured by Harima Chemicals, Inc., or ES3604 or ES6538 manufactured by Japan U-Pica Company Ltd.; an acrylic polyol-based resin such as BURNOCK WE-300 or WE-304 manufactured by DIC Corporation; a polyvinyl alcohol-based resin such as KURARAY POVAL PVA-203 manufactured by KURARAY CO., LTD.; a polyvinyl acetal-based resin such as BX-1 or BM-1 manufactured by SEKISUI CHEMICAL CO., LTD.; a polyamide-based resin such as TORESIN FS-350 manufactured by Nagase ChemteX Corporation; a carboxyl group-containing resin such as AQUALIC manufactured by NIPPON SHOKUBAI CO., LTD. or FINELEX SG2000 manufactured by Namariichi Co., Ltd.; a polyamine resin such as LUCKAMIDE manufactured by DIC Corporation; and a polythiol resin such as QE-340M manufactured by Toray Fine Chemicals Co., Ltd.

The weight-average molecular weight (Mw) of the resin D more preferably falls within the range of from 5,000 to 400,000.

Examples of a method of quantifying the polymerizable functional group in the resin include the following methods: the titration of a carboxyl group with potassium hydroxide, the titration of an amino group with sodium nitrite, and the titration of a hydroxy group with acetic anhydride and potassium hydroxide. Further examples thereof include the titration of a thiol group with 5,5'-dithiobis(2-nitrobenzoic acid) and a calibration curve method involving obtaining the amount of the polymerizable functional group from the IR spectrum of a sample whose polymerizable functional group introduction ratio has been changed.

Table 18 below shows specific examples of the resin D. The column "other site" in Table 18 refers to a characteristic structure and represents a structural unit represented by any one of the formulae (E-1) to (E-5).

TABLE 18

| Kind of resin | Structure represented by formula (D) $R^{11}$ | $Y^1$ | $W^1$ | Number of moles of functional group per g | Other site | Molecular weight |
|---|---|---|---|---|---|---|
| D1 | H | Single bond | OH | 3.3 mmol | Butyral | $1 \times 10^5$ |
| D2 | H | Single bond | OH | 3.3 mmol | Butyral | $4 \times 10^4$ |
| D3 | H | Single bond | OH | 3.3 mmol | Butyral | $2 \times 10^4$ |
| D4 | H | Single bond | OH | 1.0 mmol | Olefin | $1 \times 10^5$ |
| D5 | H | Single bond | OH | 3.0 mmol | Ester | $8 \times 10^4$ |
| D6 | H | Single bond | OH | 2.5 mmol | Ether | $5 \times 10^4$ |
| D7 | H | Single bond | OH | 2.8 mmol | Cellulose | $3 \times 10^4$ |
| D8 | H | Single bond | COOH | 3.5 mmol | Olefin | $6 \times 10^4$ |
| D9 | H | Single bond | $NH_2$ | 1.2 mmol | Polyamide | $2 \times 10^5$ |
| D10 | H | Single bond | SH | 1.3 mmol | Olefin | $8 \times 10^3$ |
| D11 | H | Phenylene group | OH | 2.8 mmol | Olefin | $6 \times 10^4$ |
| D12 | H | Single bond | OH | 3.0 mmol | Butyral | $7 \times 10^4$ |
| D13 | H | Single bond | OH | 2.9 mmol | Ester | $2 \times 10^4$ |
| D14 | H | Single bond | OH | 2.5 mmol | Ester | $6 \times 10^3$ |
| D15 | H | Single bond | OH | 2.7 mmol | Ester | $8 \times 10^4$ |
| D16 | H | Single bond | COOH | 1.4 mmol | Olefin | $2 \times 10^5$ |
| D17 | H | Single bond | COOH | 2.2 mmol | Ester | $9 \times 10^3$ |
| D18 | H | Single bond | COOH | 2.8 mmol | Ester | $8 \times 10^2$ |
| D19 | $CH_3$ | Single bond | OH | 2.0 mmol | Ester | $5 \times 10^3$ |
| D20 | $C_2H_5$ | Single bond | OH | 1.2 mmol | Olefin | $6 \times 10^2$ |

The second intermediate layer may contain, for example, any other resin, an organic particle, an inorganic particle, or a leveling agent in addition to the polymerized product in order that the film formability and electrical characteristics of the second intermediate layer may be improved. It is to be noted that the content of any such material in the second intermediate layer is preferably less than 50 mass %, more preferably less than 20 mass % with respect to the total mass of the second intermediate layer.

The thickness of the second intermediate layer is preferably 0.1 μm or more and 1.5 μm or less, more preferably 0.2 μm or more and 0.7 μm or less.

The content of the electron transport substance in the composition of the second intermediate layer with respect to the metal oxide particles of the first intermediate layer is preferably 0.2 mass % or more and 15 mass % or less. In addition, the total content of the electron transport substance and crosslinking agent in the composition of the second intermediate layer with respect to the metal oxide particles of the first intermediate layer is preferably 0.5 mass % or more and 20 mass % or less. When the contents fall within the ranges, the voltage fluctuation of the exposed portion in repeated image formation under a high-temperature and high-humidity environment is additionally suppressed.

The layer construction of the electrophotographic photosensitive member of the present invention is described below. The electrophotographic photosensitive member of the present invention is an electrophotographic photosensitive member including a support, a first intermediate layer formed on the support, a second intermediate layer formed on the first intermediate layer, and a photosensitive layer formed on the second intermediate layer. The photosensitive layer is preferably a laminated (separated-function) photosensitive layer separated into a charge generation layer containing a charge generation substance and a hole transport layer containing a hole transport substance.

Figure 2:
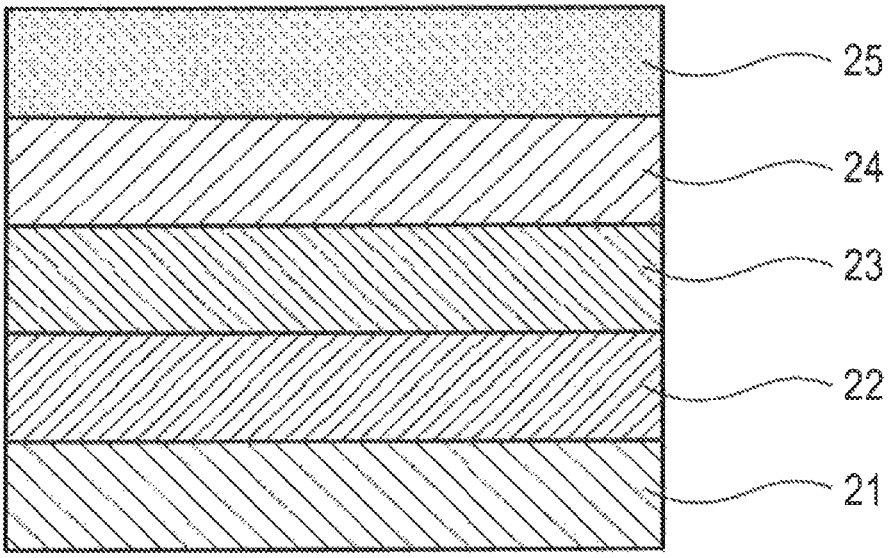
FIG. 2 is a view illustrating an example of the layer construction of the electrophotographic photosensitive member.

FIG. 2 is a view illustrating an example of the layer construction of the electrophotographic photosensitive member. In FIG. 2, the support is represented by reference numeral 21, the first intermediate layer is represented by reference numeral 22, the second intermediate layer is represented by reference numeral 23, the charge generation layer is represented by reference numeral 24, and the hole transport layer is represented by reference numeral 25.

(First Intermediate Layer)

The first intermediate layer is as described above.

(Second Intermediate Layer)

The second intermediate layer is as described above.

(Support)

The support only needs to be a support having conductivity (conductive support), and a support made of a metal (or made of an alloy) such as aluminum, an aluminum alloy, or stainless steel can be used. In addition, the support made of a metal, or a support made of a plastic, having a layer obtained by forming aluminum, an aluminum alloy, an indium oxide-tin oxide alloy, or the like into a film through vacuum deposition can be used. In addition, examples of the shape of the support include a cylindrical shape and a belt shape. Of those, a cylindrical shape is preferred. In addition, the surface of the support may be subjected to cutting treatment, roughening treatment, or alumite treatment for the purpose of the suppression of interference fringes due to the scattering of laser light.

(Charge Generation Layer)

The charge generation layer can be formed by: applying an application liquid for the charge generation layer obtained by dispersing the charge generation substance together with a binder resin and a solvent; and drying the liquid. In addition, the charge generation layer may be a deposited film of the charge generation substance.

Examples of the charge generation substance include an azo pigment, a phthalocyanine pigment, an indigo pigment, a perylene pigment, a polycyclic quinone pigment, a quinacridone pigment, an azulenium salt pigment, and a styryl dye. One kind of those charge generation substances may be used alone, or two or more kinds thereof may be used.

In addition, of those charge generation substances, a phthalocyanine pigment or an azo pigment is preferred from the viewpoint of sensitivity. In particular, a phthalocyanine pigment is more preferred.

In addition, out of the phthalocyanine pigments, in particular, an oxytitanium phthalocyanine, a chlorogallium phthalocyanine, or a hydroxygallium phthalocyanine shows excellent charge generation efficiency. Further, out of the hydroxygallium phthalocyanines, a hydroxygallium phthalocyanine crystal of a crystal form having peaks at Bragg angles 2θ in CuKα characteristic X-ray diffraction of 7.4°±0.3° and 28.2°±0.3° is more preferred from the viewpoint of a potential characteristic.

Examples of the binder resin to be used in the charge generation layer in the case where the photosensitive layer is a laminated photosensitive layer include an acrylic resin, an allyl resin, an alkyd resin, an epoxy resin, a diallyl phthalate resin, a styrene-butadiene copolymer, a butyral resin, a benzal resin, polyacrylate, polyacetal, polyamide imide, polyamide, polyallyl ether, polyarylate, polyimide, polyurethane, polyester, polyethylene, polycarbonate, polystyrene, polysulfone, polyvinyl acetal, polybutadiene, polypropylene, a methacrylic resin, a urea resin, a vinyl chloride-vinyl acetate copolymer, a vinyl acetate resin, and a vinyl chloride resin. Of those, a butyral resin is particularly preferred. One kind of those resins may be used alone, or two or more kinds thereof may be used as a mixture or a copolymer.

A ratio between the charge generation substance and the binder resin preferably falls within the range of from 0.3:1 to 10:1 in terms of a mass ratio.

Examples of the solvent to be used in the application liquid for the charge generation layer include an alcohol, a sulfoxide, a ketone, an ether, an ester, an aliphatic halogenated hydrocarbon, and an aromatic compound.

The thickness of the charge generation layer is preferably 5 μm or less. In particular, the thickness is more preferably 0.1 μm or more and 2 μm or less. In addition, various sensitizers, antioxidants, UV absorbers, and plasticizers can each be added to the charge generation layer as required.

(Hole Transport Layer)

The hole transport layer can be formed by: applying an application liquid for the hole transport layer obtained by dissolving the hole transport substance and a binder resin in a solvent to form a coat; and drying the coat.

Examples of the hole transport substance include a triarylamine compound, a hydrazone compound, a styryl compound, a stilbene compound, and a butadiene compound. Of those, a triarylamine compound is preferred from the viewpoint of a high charge mobility.

Examples of the binder resin to be used in the hole transport layer in the case where the photosensitive layer is a laminated photosensitive layer include an acrylic resin, an acrylonitrile resin, an allyl resin, an alkyd resin, an epoxy resin, a silicone resin, a phenol resin, a phenoxy resin, polyacrylamide, polyamide imide, polyamide, polyallyl ether, polyarylate, polyimide, polyurethane, polyester, polyethylene, polycarbonate, polysulfone, polyphenylene oxide, polybutadiene, polypropylene, and a methacrylic resin. In particular, polyarylate or polycarbonate is preferred. One kind of those binder resins may be used alone, or two or more kinds thereof may be used as a mixture or a copolymer.

A ratio between the hole transport substance and the binder resin preferably falls within the range of from 0.3:1 to 10:1 in terms of a mass ratio. In addition, the temperature at which the coat is dried is preferably 60° C. or more and 150° C. or less from the viewpoint of suppressing a crack. In particular, the drying temperature is more preferably 80° C. or more and 120° C. or less. In addition, the time period for which the coat is dried is preferably 10 minutes or more and 60 minutes or less.

Examples of the solvent to be used in the application liquid for the hole transport layer include an alcohol (in particular, an alcohol having 3 or more carbon atoms), an aromatic hydrocarbon such as anisole, toluene, xylene, or chlorobenzene, methylcyclohexane, and ethylcyclohexane.

When the hole transport layer is of a laminated construction, a hole transport layer on the surface side of the photosensitive member is preferably a layer obtained by polymerizing and/or crosslinking a hole transport substance having a chain polymerizable functional group to cure the substance in order that its mechanical strength may be improved. Examples of the chain polymerizable functional group include an acrylic group, an alkoxysilyl group, and an epoxy group. Heat, light, or a radiation (such as an electron beam) can be used for polymerizing and/or crosslinking the hole transport substance having the chain polymerizable functional group.

When the number of the hole transport layers of the electrophotographic photosensitive member is one, the thickness of the hole transport layer is preferably 5 μm or more and 40 μm or less. In particular, the thickness is more preferably 8 μm or more and 30 μm or less.

When the hole transport layer is of the laminated construction, the thickness of a hole transport layer on the support side of the electrophotographic photosensitive member is preferably 5 μm or more and 30 μm or less, and the thickness of the hole transport layer on the surface side of the electrophotographic photosensitive member is preferably 1 μm or more and 10 μm or less.

In addition, an antioxidant, a UV absorber, a plasticizer, or the like can be added to the hole transport layer as required.

In the application of the application liquid for each layer, there may be employed, for example, an application method such as a dip coating method, a spray coating method, a spinner coating method, a roller coating method, a Mayer bar coating method, or a blade coating method.

In addition, a lubricant such as a silicone oil, a wax, a polytetrafluoroethylene particle, a silica particle, an alumina particle, or boron nitride may be incorporated into the layer on the outermost surface of the electrophotographic photosensitive member (surface layer).

Process Cartridge and Electrophotographic Apparatus

FIG. 1 illustrates the schematic construction of an electrophotographic apparatus including a process cartridge including an electrophotographic photosensitive member.

In FIG. 1, an electrophotographic photosensitive member 1 having a cylindrical shape is rotationally driven about an axis 2 in a direction indicated by an arrow at a predetermined peripheral speed. The surface (peripheral surface) of the electrophotographic photosensitive member 1 to be rotationally driven is uniformly charged to a predetermined positive or negative potential by a charging unit 3 (primary charging unit such as a charging roller). Next, the surface receives exposure light (image exposure light) 4 from an exposing unit (not shown) such as slit exposure or laser beam scanning exposure. Thus, electrostatic latent images corresponding to the target image are sequentially formed on the surface of the electrophotographic photosensitive member 1.

The electrostatic latent images formed on the surface of the electrophotographic photosensitive member 1 are then developed with toner in the developer of a developing unit 5 to become toner images. Next, the toner images formed on and carried by the surface of the electrophotographic photosensitive member 1 are sequentially transferred onto a transfer material P (such as paper) by a transfer bias from a transferring unit 6 (such as a transfer roller). It is to be noted that the transfer material P is taken out and supplied from a transfer material-supplying unit (not shown) to a space (abutment portion) between the electrophotographic photosensitive member 1 and the transferring unit 6 in synchronization with the rotation of the electrophotographic photosensitive member 1.

The transfer material P onto which the toner images have been transferred is separated from the surface of the electrophotographic photosensitive member 1 and introduced into a fixing unit 8, where the images are fixed. Thus, the transfer material is printed out as an image-formed product (print or copy) to the outside of the apparatus.

The surface of the electrophotographic photosensitive member 1 after the transfer of the toner images is cleaned through the removal of a transfer residual developer (toner) by a cleaning unit 7 (such as a cleaning blade). Next, the surface is subjected to antistatic treatment by pre-exposure light (not shown) from a pre-exposing unit (not shown), and is then repeatedly used in image formation. It is to be noted that when the charging unit 3 is a contact charging unit using a charging roller as illustrated in FIG. 1, pre-exposure is not necessarily needed.

The following procedure may be adopted: two or more of components such as the electrophotographic photosensitive member 1, the charging unit 3, the developing unit 5, the transferring unit 6, and the cleaning unit 7 are selected, stored in a container, and integrally coupled to form a process cartridge, and the process cartridge is removably mounted onto the main body of the electrophotographic apparatus such as a copying machine or a laser beam printer. In FIG. 1, the electrophotographic photosensitive member 1, the charging unit 3, the developing unit 5, and the cleaning unit 7 are integrally supported to from a cartridge. In addition, the cartridge serves as a process cartridge 9 removably mounted onto the main body of the electrophotographic apparatus by using a guiding unit 10 such as the rail of the main body of the electrophotographic apparatus.

The invention of the present application is hereinafter described in more detail by way of Examples. However, the invention of the present application is by no means limited thereto. It is to be noted that "%" and "part(s)" in Examples mean "mass %" and "part(s) by mass," respectively.

Next, the production and evaluations of an electrophotographic photosensitive member are described.

Application Liquid 1 for First Intermediate Layer

100 Parts of zinc oxide particles (number-average primary particle diameter: 50 nm, specific surface area (hereinafter referred to as "BET value"): 19 $m^2/g$, powder resistance: $3.7\times10^5$ Ω·cm) were mixed with 500 parts of toluene under stirring, and 1.25 parts of N-2-(aminoethyl)-3-aminopropylmethyldimethoxysilane (trade name: KBM602, manufactured by Shin-Etsu Chemical Co., Ltd.) were added to the mixture, followed by stirring for 2 hours. After that, toluene was removed by distillation under reduced pressure and the residue was baked at 120° C. for 3 hours. Thus, surface-treated zinc oxide particles M1 were obtained.

Next, 15 parts of a polyvinyl acetal resin (trade name: BM-1, manufactured by SEKISUI CHEMICAL CO., LTD.) and 10 parts of a blocked isocyanate (trade name: Sumidur 3175, manufactured by Sumitomo Bayer Urethane Co., Ltd.) were dissolved in a mixed solvent of 85 parts of methyl ethyl ketone and 36.5 parts of 1-butanol. 67.5 Parts of the surface-treated zinc oxide particles M1 and 0.7 part of 2,3,4-trihydroxybenzophenone (manufactured by Tokyo Chemical Industry Co., Ltd.) were added to the liquid, and the mixture was dispersed with a sand mill apparatus using glass beads each having a diameter of 1 mm under an atmosphere at 23±3° C. for 3 hours. After the dispersion, 3.4 parts of crosslinked polymethyl methacrylate particles (SSX-103 manufactured by SEKISUI PLASTICS CO., LTD.) as resin particles and 0.007 part of a silicone oil SH28PA (manufactured by Dow Corning Toray Co., Ltd.) were added to the resultant, and the mixture was stirred. Thus, an application liquid 1 for a first intermediate layer was prepared.

A first intermediate layer was formed by using the application liquid 1 for a first intermediate layer and an electrophotographic photosensitive member was produced as described below. The number-average primary particle diameter of the metal oxide particles of the electrophotographic photosensitive member having the first intermediate layer was measured by the following method. As a result, the number-average primary particle diameter of the metal oxide particles was 55 nm.

Application Liquid 2 for First Intermediate Layer

An application liquid 2 for a first intermediate layer was obtained in the same manner as in the application liquid 1 for a first intermediate layer with the exception that 2,3,4-trihydroxybenzophenone was not used.

As in the application liquid 1 for a first intermediate layer, a first intermediate layer was formed by using the application liquid 2 for a first intermediate layer, and the number-average primary particle diameter of its metal oxide particles was measured. As a result, the number-average primary particle diameter of the metal oxide particles was 55 nm.

Application liquid 3 for first intermediate layer 100 Parts of zinc oxide particles (number-average primary particle diameter: 50 nm, specific surface area (hereinafter referred to as "BET value"): 19 $m^2/g$, powder resistance: $3.7\times10^5$ Ω·cm) were mixed with 500 parts of toluene under stirring, and 1.25 parts of N-2-(aminoethyl)-3-aminopropyltrimethoxysilane (trade name: KBM603, manufactured by Shin-Etsu Chemical Co., Ltd.) were added to the mixture, followed by stirring for 2 hours. After that, toluene was removed by distillation under reduced pressure and the residue was baked at 120° C. for 3 hours. Thus, surface-treated zinc oxide particles M2 were obtained.

Next, 15 parts of a polyvinyl acetal resin (BM-1) and 10 parts of a blocked isocyanate (Sumidur 3175) were dissolved in a mixed solvent of 85 parts of methyl ethyl ketone and 36.5 parts of 1-butanol. 67.5 Parts of the surface-treated zinc oxide particles M2 and 0.7 part of 1,2-dihydroxyanthraquinone (manufactured by Tokyo Chemical Industry Co., Ltd.) were added to the liquid, and the mixture was dispersed with a sand mill apparatus using glass beads each having a diameter of 1 mm under an atmosphere at 23±3° C. for 3 hours. After the dispersion, 0.005 part of dioctyltin dilaurate (catalyst) as a catalyst and 4.0 parts of silicone resin particles (trade name: TOSPEARL 145, manufactured by Momentive Performance Materials Inc.) were added to the resultant, and the mixture was stirred. Thus, an application liquid 3 for a first intermediate layer was prepared.

As in the application liquid 1 for a first intermediate layer, a first intermediate layer was formed by using the application liquid 3 for a first intermediate layer, and the number-average primary particle diameter of its metal oxide particles was measured. As a result, the number-average primary particle diameter of the metal oxide particles was 55 nm.

Application liquid 4 for first intermediate layer 100 Parts of titanium oxide particles (TTO-55(B) manufactured by ISHIHARA SANGYO KAISHA, LTD., number-average primary particle diameter: 30 to 50 nm) were mixed with 500 parts of toluene under stirring, and 1.25 parts of N-2-(aminoethyl)-3-aminopropyltrimethoxysilane (KBM603) were added to the mixture, followed by stirring for 2 hours. After that, toluene was removed by distillation under reduced pressure and the residue was baked at 120° C. for 3 hours. Thus, surface-treated titanium oxide particles N1 were obtained. Next, an application liquid 4 for a first intermediate layer was obtained in the same manner as in the application liquid 1 for a first intermediate layer with the exception that the titanium oxide particles N1 were used as metal oxide particles.

As in the application liquid 1 for a first intermediate layer, a first intermediate layer was formed by using the application liquid 4 for a first intermediate layer, and the number-average primary particle diameter of its metal oxide particles was measured. As a result, the number-average primary particle diameter of the metal oxide particles was 40 nm.

Application liquid 5 for first intermediate layer 100 Parts of titanium oxide particles (CR-EL manufactured by ISHIHARA SANGYO KAISHA, LTD., number-average primary particle diameter: 250 nm) were mixed with 500 parts of toluene under stirring, and 1.25 parts of N-2-(aminoethyl)-3-aminopropyltrimethoxysilane (KBM60) were added to the mixture, followed by stirring for 2 hours. After that, toluene was removed by distillation under reduced pressure and the residue was baked at 120° C. for 3 hours. Thus, surface-treated titanium oxide particles N2 were obtained.

Next, an application liquid 5 for a first intermediate layer was obtained in the same manner as in the application liquid 1 for a first intermediate layer with the exception that the titanium oxide particles N2 were used as metal oxide particles.

As in the application liquid 1 for a first intermediate layer, a first intermediate layer was formed by using the application liquid 5 for a first intermediate layer, and the number-average primary particle diameter of its metal oxide particles was measured. As a result, the number-average primary particle diameter of the metal oxide particles was 260 nm.

Application liquid 6 for first intermediate layer An application liquid 6 for a first intermediate layer was obtained in the same manner as in the application liquid 5 for a first intermediate layer with the exception that 2,3,4-trihydroxybenzophenone was not used.

As in the application liquid 1 for a first intermediate layer, a first intermediate layer was formed by using the application liquid 6 for a first intermediate layer, and the number-average primary particle diameter of its metal oxide particles was measured. As a result, the number-average primary particle diameter of the metal oxide particles was 260 nm.

Application liquid 7 for first intermediate layer 100 Parts of titanium oxide particles (EC-100 manufactured by ISHIHARA SANGYO KAISHA, LTD., number-average primary particle diameter: 320 to 400 nm) were mixed with 500 parts of toluene under stirring, and 1.25 parts of N-2-(aminoethyl)-3-aminopropyltrimethoxysilane (KBM603) were added to the mixture, followed by stirring for 2 hours. After that, toluene was removed by distillation under reduced pressure and the residue was baked at 120° C. for 3 hours. Thus, surface-treated titanium oxide particles N3 were obtained. Next, an application liquid 7 for a first intermediate layer was obtained in the same manner as in the application liquid 1 for a first intermediate layer with the exception that the titanium oxide particles N3 were used as metal oxide particles.

As in the application liquid 1 for a first intermediate layer, a first intermediate layer was formed by using the application liquid 7 for a first intermediate layer, and the number-average primary particle diameter of its metal oxide particles was measured. As a result, the number-average primary particle diameter of the metal oxide particles was 400 nm.

Application liquid 8 for first intermediate layer 100 Parts of titanium oxide particles (TTO-55(A) manufactured by ISHIHARA SANGYO KAISHA, LTD., number-average primary particle diameter: 10 to 30 nm) were mixed with 500 parts of toluene under stirring, and 1.25 parts of N-2-(aminoethyl)-3-aminopropyltrimethoxysilane (KBM603) were added to the mixture, followed by stirring for 2 hours. After that, toluene was removed by distillation under reduced pressure and the residue was baked at 120° C. for 3 hours. Thus, surface-treated titanium oxide particles N4 were obtained. Next, an application liquid 8 for a first intermediate layer was obtained in the same manner as in the application liquid 1 for a first intermediate layer with the exception that the titanium oxide particles N4 were used as metal oxide particles.

As in the application liquid 1 for a first intermediate layer, a first intermediate layer was formed by using the application liquid 8 for a first intermediate layer, and the number-average primary particle diameter of its metal oxide particles was measured. As a result, the number-average primary particle diameter of the metal oxide particles was 20 nm.

Application liquid 9 for first intermediate layer 100 Parts of titanium oxide particles (EC-210 manufactured by ISHIHARA SANGYO KAISHA, LTD., number-average primary particle diameter: 450 to 500 nm) were mixed with 500 parts of toluene under stirring, and 1.25 parts of N-2-(aminoethyl)-3-aminopropyltrimethoxysilane (KBM603) were added to the mixture, followed by stirring for 2 hours. After that, toluene was removed by distillation under reduced pressure and the residue was baked at 120° C. for 3 hours. Thus, surface-treated titanium oxide particles N5 were obtained.

Next, an application liquid 9 for a first intermediate layer was obtained in the same manner as in the application liquid 1 for a first intermediate layer with the exception that the titanium oxide particles N5 were used as metal oxide particles. As in the application liquid 1 for a first intermediate layer, a first intermediate layer was formed by using the application liquid 9 for a first intermediate layer, and the number-average primary particle diameter of its metal oxide particles was measured. As a result, the number-average primary particle diameter of the metal oxide particles was 510 nm.

Application Liquid 10 for First Intermediate Layer

100 Parts of zinc oxide particles (number-average primary particle diameter: 50 nm, specific surface area (hereinafter referred to as "BET value"): 19 $m^2/g$, powder resistance: $3.7\times10^5$ Ω·cm) were mixed with 500 parts of toluene under stirring, and 1.25 parts of N-2-(aminoethyl)-3-aminopropylmethyldimethoxysilane (trade name: KBM602, manufactured by Shin-Etsu Chemical Co., Ltd.) were added to the mixture, followed by stirring for 2 hours. After that, toluene was removed by distillation under reduced pressure and the residue was baked at 120° C. for 3 hours. Thus, surface-treated zinc oxide particles M1 were obtained.

Next, 10.5 parts of a polyvinyl acetal resin (trade name: BM-1, manufactured by SEKISUI CHEMICAL CO., LTD.) and 25 parts of a blocked isocyanate (trade name: Sumidur 3175, manufactured by Sumitomo Bayer Urethane Co., Ltd.) were dissolved in a mixed solvent of 65.5 parts of methyl ethyl ketone and 65.5 parts of 1-butanol. 85 Parts of the surface-treated zinc oxide particles M1 and 0.85 part of 2,3,4-trihydroxybenzophenone (manufactured by Tokyo Chemical Industry Co., Ltd.) were added to the liquid, and the mixture was dispersed with a sand mill apparatus using glass beads each having a diameter of 1 mm under an atmosphere at 23±3° C. for 3 hours. After the dispersion, 5.7 parts of crosslinked polymethyl methacrylate particles (SSX-103 manufactured by SEKISUI PLASTICS CO., LTD.) as resin particles and 0.011 part of a silicone oil SH28PA (manufactured by Dow Corning Toray Co., Ltd.) were added to the resultant, and the mixture was stirred. Thus, an application liquid 10 for a first intermediate layer was prepared.

A first intermediate layer was formed by using the application liquid 10 for a first intermediate layer and an electrophotographic photosensitive member was produced as described below. The number-average primary particle diameter of the metal oxide particles of the electrophotographic photosensitive member having the first intermediate layer was measured by the following method. As a result, the number-average primary particle diameter of the metal oxide particles was 55 nm.

Application Liquid 11 for First Intermediate Layer

100 Parts of zinc oxide particles (number-average primary particle diameter: 50 nm, specific surface area (hereinafter referred to as "BET value"): 19 $m^2/g$, powder resistance: $3.7\times10^5$ Ω·cm) were mixed with 500 parts of toluene under stirring, and 1.25 parts of N-2-(aminoethyl)-3-aminopropyltrimethoxysilane (trade name: KBM603, manufactured by Shin-Etsu Chemical Co., Ltd.) were added to the mixture, followed by stirring for 2 hours. After that, toluene was removed by distillation under reduced pressure and the residue was baked at 120° C. for 3 hours. Thus, surface-treated zinc oxide particles M2 were obtained.

Next, 10.5 parts of a polyvinyl acetal resin (BM-1) and 25 parts of a blocked isocyanate (Sumidur 3175) were dissolved in a mixed solvent of 65.5 parts of methyl ethyl ketone and 65.5 parts of 1-butanol. 85 Parts of the surface-treated zinc oxide particles M2 and 0.85 part of 1,2-dihydroxyanthraquinone (manufactured by Tokyo Chemical Industry Co., Ltd.) were added to the liquid, and the mixture was dispersed with a sand mill apparatus using glass beads each having a diameter of 1 mm under an atmosphere at 23±3° C. for 3 hours. After the dispersion, 0.005 part of dioctyltin dilaurate (catalyst) as a catalyst and 5.7 parts of silicone resin particles (trade name: TOSPEARL 145, manufactured by Momentive Performance Materials Inc.) were added to the resultant, and the mixture was stirred. Thus, an application liquid 11 for a first intermediate layer was prepared.

As in the application liquid 1 for a first intermediate layer, a first intermediate layer was formed by using the application liquid 11 for a first intermediate layer, and the number-average primary particle diameter of its metal oxide particles was measured. As a result, the number-average primary particle diameter of the metal oxide particles was 55 nm.

Example 1

An aluminum cylinder having a diameter of 30 mm (JIS-A3003, aluminum alloy, length: 357.5 mm) was used as a support (conductive support).

Next, the application liquid 1 for a first intermediate layer was applied to the support by immersion, and the resultant coat was dried for 40 minutes at 180° C. to form a first intermediate layer having a thickness of 30 μm.

Next, 4 parts of the electron transport substance (A101), 5.5 parts of a crosslinking agent (B1:protective group (H1) =5.1:2.2 (mass ratio)), 0.3 part of the resin (D1), and 0.05 part of dioctyltin laurate as a catalyst were dissolved in a mixed solvent of 100 parts of dimethylacetamide and 100 parts of methyl ethyl ketone to prepare an application liquid for a second intermediate layer. The application liquid for a second intermediate layer was applied onto the first intermediate layer by immersion, and the resultant coat was heated and polymerized for 40 minutes at 160° C. to form a second intermediate layer having a thickness of 0.5 μm. $R^{21}$ of the characteristic structure (E−1) in the resin D1 represents $C_3H_7$.

Next, a hydroxygallium phthalocyanine crystal (charge generation substance) of a crystal form having peaks at Bragg angles (2θ±0.2°) in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 0.1 part of a compound represented by the following formula (3), 5 parts of polyvinyl butyral (trade name: S-LEC BX-1, manufactured by SEKISUI CHEMICAL CO., LTD.), and 250 parts of cyclohexanone were loaded into a sand mill using glass beads each having a diameter of 0.8 mm, and the mixture was subjected to dispersion treatment for 1.5 hours. Next, 250 parts of ethyl acetate were added to the resultant to prepare an application liquid for a charge generation layer.

(3)

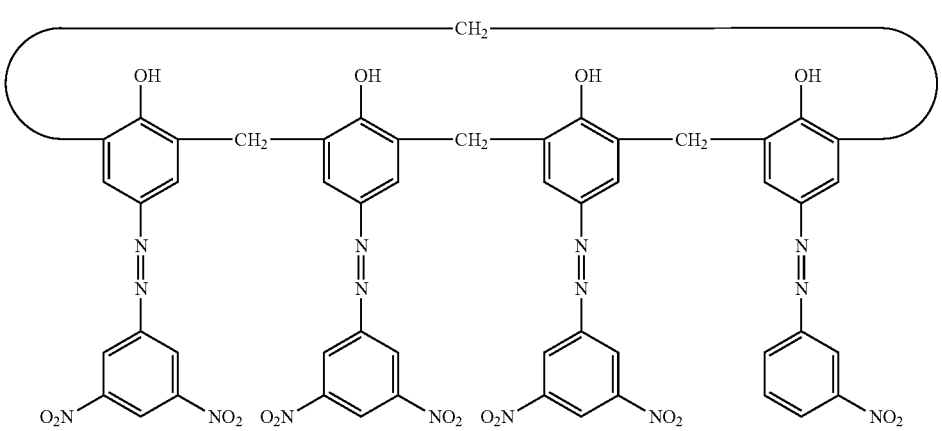

The application liquid for a charge generation layer was applied onto the electron transport layer by immersion, and the resultant coat was dried for 10 minutes at 100° C. to form a charge generation layer having a thickness of 0.15 μm.

Next, 4 parts of a triarylamine compound represented by the following formula (CTM-1), 4 parts of a benzidine compound represented by the following formula (CTM-2), and 10 parts of bisphenol Z-type polycarbonate (trade name: 2400, manufactured by Mitsubishi Engineering-Plastics Corporation) were dissolved in a mixed solvent of 40 parts of dimethoxymethane and 60 parts of chlorobenzene to prepare an application liquid for a hole transport layer. The application liquid for a hole transport layer was applied onto the charge generation layer by immersion, and the resultant coat was dried for 40 minutes at 120° C. to form a hole transport layer having a thickness of 15 μm.

(CTM-1)

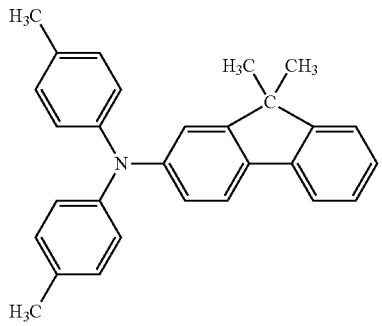

-continued (CTM-2)

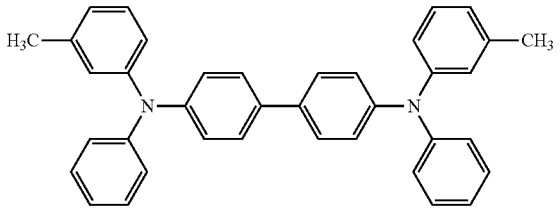

Thus, an electrophotographic photosensitive member for evaluations for a voltage fluctuation and a black spot was produced.

(Measurement of Number-Average Primary Particle Diameter)

The produced electrophotographic photosensitive member was cut and a sample for cross-sectional observation was produced by using a cross-section polisher (cross-sectional sample-producing apparatus). The metal oxide particles in a cross-sectional photograph of the first intermediate layer taken with a scanning electron microscope (SEM) at a certain magnification and a cross-sectional photograph mapped with an element of the metal oxide particles by using an element-analyzing unit such as an X-ray microanalyzer (XMA) included with the SEM were checked against each other. Next, the projected areas of the primary particles of the 100 metal oxide particles were measured, and the diameter of a circle whose area was equal to the measured projected area of each metal oxide particle was determined as the diameter of each metal oxide particle. The number-average primary particle diameter of the metal oxide particles was calculated based on the results and the calculated value was defined as the number-average primary particle diameter.

(Evaluation for Black Spot)

An evaluation was performed by mounting the produced electrophotographic photosensitive member for evaluations on a reconstructed machine of a laser beam printer (trade name: LBP-2510) manufactured by Canon Inc. Details about the evaluation are as described below.

The printer was reconstructed as follows: a charging condition and a laser exposure were set so that with regard to the surface potential of the electrophotographic photosensitive member, an initial dark portion potential became −550 V and an exposed portion potential became −150 V under an environment having a temperature of 35° C. and a humidity of 85% RH. Surface potential measurement was performed as described below. A cartridge was reconstructed and a potential probe (trade name: model 6000B-8, manufactured by TREK JAPAN) was mounted at a development position. Then, a potential at the central portion of the electrophotographic photosensitive member was measured with a surface potentiometer (trade name: model 344, manufactured by TREK JAPAN).

In the evaluation for a black spot, an entirely solid white image was output on A4 size glossy paper. The number of black spots in the area of the output image corresponding to 1 round of the electrophotographic photosensitive member (a rectangular region whose longitudinal length was 297 mm corresponding to the longer side length of the A4 paper and whose horizontal length was 94.2 mm corresponding to 1 round of the electrophotographic photosensitive member) was visually evaluated by the following criteria. Table 21 shows the result of the evaluation.

Rank A: No black spot is observed.

Rank B: 1 to 3 black spots each having a diameter of more than 0.3 mm are observed.

Rank C: 4 or 5 black spots each having a diameter of more than 0.3 mm are observed.

Rank D: 6 or 7 black spots each having a diameter of more than 0.3 mm are observed.

Rank E: 8 or more black spots each having a diameter of more than 0.3 mm are observed.

(Evaluation for Voltage Fluctuation)

An evaluation was performed by mounting the produced electrophotographic photosensitive member for evaluations on a reconstructed machine of a laser beam printer (trade name: LBP-2510) manufactured by Canon Inc. Details about the evaluation are as described below.

The printer was reconstructed as follows: a charging condition and a laser exposure were set so that with regard to the surface potential of the electrophotographic photosensitive member, an initial dark portion potential became −550 V and an exposed portion potential became −150 V under a high-temperature and high-humidity environment (having a temperature of 35° C. and a humidity of 85% RH). At the time of paper feeding, a character image having a print percentage of 1% was repeatedly formed on 10,000 sheets of A4 size plain paper with a cyan color alone. An initial exposed portion potential and an exposed portion potential after the repeated image formation on the 10,000 sheets at this time were compared, and the difference therebetween was defined as a value for a voltage fluctuation (ΔV1). Table 21 shows the result of the evaluation.

Examples 2 to 49

Electrophotographic photosensitive members were each produced in the same manner as in Example 1 with the exception that in Example 1, the kind of the application liquid for a first intermediate layer, the thickness of the first intermediate layer, the electron transport substance, the thickness of the second intermediate layer, the content of the electron transport substance, the crosslinking agent, and the resin were changed as shown in Table 19, and the electrophotographic photosensitive members were similarly evaluated.

Example 50

An electrophotographic photosensitive member was produced in the same manner as in Example 1 with the exception that the second intermediate layer was formed as descried below, and the electrophotographic photosensitive member was similarly evaluated. Table 21 shows the results.

5 Parts of the electron transport substance (A117), 3.5 parts of the crosslinking agent (C1-3), 3.4 parts of the resin (D1), and 0.1 part of dodecylbenzenesulfonic acid as a catalyst were dissolved in a mixed solvent of 100 parts of dimethylacetamide and 100 parts of methyl ethyl ketone to prepare an application liquid for a second intermediate layer. The application liquid for a second intermediate layer was applied onto the first intermediate layer by immersion, and the resultant coat was heated and polymerized for 40 minutes at 160° C. to form a second intermediate layer having a thickness of 0.5 μm.

Examples 51 to 97

Electrophotographic photosensitive members were each produced in the same manner as in Example 50 with the exception that in Example 50, the kind of the application liquid for a first intermediate layer, the thickness of the first intermediate layer, the electron transport substance, the thickness of the second intermediate layer, the content of the electron transport substance, the crosslinking agent, and the resin were changed as shown in Table 20, and the electrophotographic photosensitive members were similarly evaluated.

Examples 98 and 99

Electrophotographic photosensitive members were each produced in the same manner as in Example 1 with the exception that the electron transport substance was changed to Exemplified Compound A119 and the kind of the application liquid for a first intermediate layer was changed as shown in Table 20, and the electrophotographic photosensitive members were similarly evaluated.

Comparative Example 1

An electrophotographic photosensitive member was produced in the same manner as in Example 1 with the exception that in Example 1, the application liquid for a first intermediate layer was changed to the application liquid 8 for a first intermediate layer, and the electrophotographic photosensitive member was similarly evaluated. Table 22 shows the results of the evaluations.

Comparative Example 2

An electrophotographic photosensitive member was produced in the same manner as in Example 1 with the exception that in Example 1, the application liquid for a first intermediate layer was changed to the application liquid 9 for a first intermediate layer, and the electrophotographic photosensitive member was similarly evaluated. Table 22 shows the results of the evaluations.

Comparative Example 3

An electrophotographic photosensitive member was produced in the same manner as in Example 1 with the exception that in Example 1, the electron transport substance was changed to a compound represented by the following formula, and the electrophotographic photosensitive member was similarly evaluated. Table 22 shows the results of the evaluations.

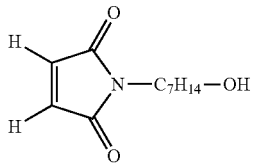

Comparative Example 4

An electrophotographic photosensitive member was produced in the same manner as in Example 1 with the exception that in Example 1, the electron transport substance was changed to 1,2-dihydroxyanthraquinone (manufactured by Wako Pure Chemical Industries, Ltd.), and the electrophotographic photosensitive member was similarly evaluated. Table 22 shows the results of the evaluations.

Comparative Example 5

With regard to the first intermediate layer, a first intermediate layer having a thickness of 6 μm and containing tin oxide particles (trade name: SN100D, manufactured by ISHIHARA SANGYO KAISHA, LTD.) was formed as described in US Patent Application Publication No. 2006/0009563. Next, with regard to the second intermediate layer, an application liquid for a second intermediate layer was produced by using a block copolymer represented by the following formula, a blocked isocyanate, and a vinyl chloride-vinyl acetate copolymer, and a layer having a thickness of 0.5 μm was formed of the liquid. An electrophotographic photosensitive member was produced in the same manner as in Example 1 except the foregoing, and was similarly evaluated. Table 22 shows the results of the evaluations.

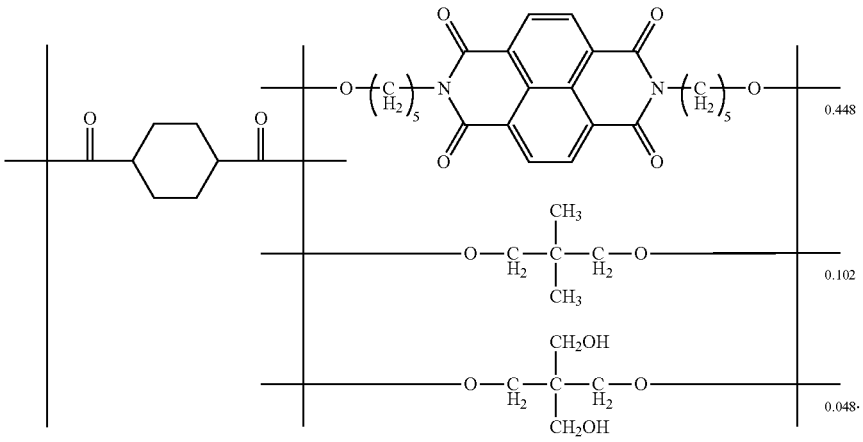

Comparative Example 6

An electrophotographic photosensitive member was produced in the same manner as in Example 1 with the exception that in Example 1, the crosslinking agent was changed to hexamethylene diisocyanate, and the electrophotographic photosensitive member was similarly evaluated. Table 22 shows the results of the evaluations.

Comparative Example 7

An electrophotographic photosensitive member was produced in the same manner as in Example 1 with the exception that in Example 1, the electron transport substance was changed to a compound (molecular weight: 1,254) represented by the following formula, and the electrophotographic photosensitive member was similarly evaluated. Table 22 shows the results of the evaluations.

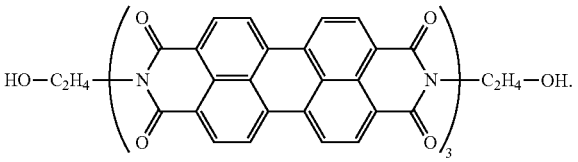

Comparative Example 8

An electrophotographic photosensitive member was produced in the same manner as in Example 1 with the exception that in Example 1, the crosslinking agent was changed to polyallylamine (PAA-05 manufactured by NITTO BOSEKI CO., LTD., molecular weight: 5,000), and the electrophotographic photosensitive member was similarly evaluated. Table 22 shows the results of the evaluations.

Comparative Example 9

An electrophotographic photosensitive member was produced in the same manner as in Example 1 with the exception that in Example 1, an undercoat layer having a thickness of 0.5 μm was formed as the second intermediate layer as follows: a liquid obtained by dissolving 5 parts of methoxymethylated nylon (weight-average molecular weight: 32,000) and 10 parts of an alcohol-soluble copolymer nylon (weight-average molecular weight: 29,000) in 95 parts of methanol was applied by immersion, and was dried at 100° C. for 20 minutes. The electrophotographic photosensitive member was similarly evaluated. Table 22 shows the results of the evaluations.

TABLE 19

| | First intermediate layer | | | Second intermediate layer | | | | |
|---|---|---|---|---|---|---|---|---|
| Example | Prepared liquid used for first intermediate layer | Metal oxide particle diameter | Thickness/ μm | Electron transport substance | Cross-linking agent | Resin | Content of electron transort substance | Thickness/ μm |
| 1 | Application liquid 1 for first intermediate layer | 55 | 30 | A101 | B1:H1 | D1 | 41% | 0.50 |
| 2 | Application liquid 2 for first intermediate layer | 55 | 30 | A101 | B1:H1 | D1 | 41% | 0.50 |
| 3 | Application liquid 3 for first intermediate layer | 55 | 30 | A101 | B1:H1 | D1 | 41% | 0.50 |
| 4 | Application liquid 4 for first intermediate layer | 40 | 30 | A101 | B1:H1 | D1 | 41% | 0.50 |
| 5 | Application liquid 5 for first intermediate layer | 260 | 30 | A101 | B1:H1 | D1 | 41% | 0.50 |
| 6 | Application liquid 6 for first intermediate layer | 260 | 30 | A101 | B1:H1 | D1 | 41% | 0.50 |
| 7 | Application liquid 7 for first intermediate layer | 400 | 30 | A101 | B1:H1 | D1 | 41% | 0.50 |
| 8 | Application liquid 1 for first intermediate layer | 55 | 30 | A204 | B1:H1 | D1 | 41% | 0.50 |
| 9 | Application liquid 1 for first intermediate layer | 55 | 30 | A304 | B1:H1 | D1 | 41% | 0.50 |
| 10 | Application liquid 1 for first intermediate layer | 55 | 30 | A401 | B1:H1 | D1 | 41% | 0.50 |
| 11 | Application liquid 1 for first intermediate layer | 55 | 30 | A508 | B1:H1 | D1 | 41% | 0.50 |
| 12 | Application liquid 1 for first intermediate layer | 55 | 30 | A607 | B1:H1 | D1 | 41% | 0.50 |
| 13 | Application liquid 1 for first intermediate layer | 55 | 30 | A702 | B1:H1 | D1 | 41% | 0.50 |
| 14 | Application liquid 1 for first intermediate layer | 55 | 30 | A807 | B1:H1 | D1 | 41% | 0.50 |
| 15 | Application liquid 1 for first intermediate layer | 55 | 30 | A909 | B1:H1 | D1 | 41% | 0.50 |
| 16 | Application liquid 1 for first intermediate layer | 55 | 30 | A1002 | B1:H1 | D1 | 41% | 0.50 |
| 17 | Application liquid 1 for first intermediate layer | 55 | 30 | A1101 | B1:H1 | D1 | 41% | 0.50 |
| 18 | Application liquid 1 for first intermediate layer | 55 | 30 | A1205 | B1:H1 | D1 | 41% | 0.50 |
| 19 | Application liquid 1 for first intermediate layer | 55 | 30 | A1309 | B1:H1 | D1 | 41% | 0.50 |
| 20 | Application liquid 1 for first intermediate layer | 55 | 30 | A1409 | B1:H1 | D1 | 41% | 0.50 |
| 21 | Application liquid 1 for first intermediate layer | 55 | 30 | A1502 | B1:H1 | D1 | 41% | 0.50 |
| 22 | Application liquid 1 for first intermediate layer | 55 | 30 | A1608 | B1:H1 | D1 | 41% | 0.50 |
| 23 | Application liquid 1 for first intermediate layer | 55 | 30 | A1712 | B1:H1 | D1 | 41% | 0.50 |
| 24 | Application liquid 1 for first intermediate layer | 55 | 30 | A101 | B1:H1 | D1 | 41% | 0.10 |
| 25 | Application liquid 1 for first intermediate layer | 55 | 30 | A101 | B1:H1 | D1 | 41% | 0.20 |
| 26 | Application liquid 1 for first intermediate layer | 55 | 30 | A101 | B1:H1 | D1 | 41% | 0.70 |
| 27 | Application liquid 1 for first intermediate layer | 55 | 30 | A101 | B1:H1 | D1 | 41% | 1.00 |
| 28 | Application liquid 1 for first intermediate layer | 55 | 30 | A101 | B1:H1 | D1 | 41% | 1.50 |
| 29 | Application liquid 1 for first intermediate layer | 55 | 30 | A101 | B1:H1 | D1 | 41% | 0.05 |
| 30 | Application liquid 1 for first intermediate layer | 55 | 30 | A101 | B1:H1 | D1 | 41% | 2.00 |
| 31 | Application liquid 1 for first intermediate layer | 55 | 30 | A101 | B1:H1 | D1 | 41% | 2.50 |
| 32 | Application liquid 1 for first intermediate layer | 55 | 30 | A101 | B1:H1 | D1 | 41% | 3.00 |
| 33 | Application liquid 1 for first intermediate layer | 55 | 30 | A101 | B1:H1 | D1 | 10% | 0.20 |
| 34 | Application liquid 1 for first intermediate layer | 55 | 30 | A101 | B1:H1 | D1 | 30% | 0.20 |
| 35 | Application liquid 1 for first intermediate layer | 55 | 10 | A101 | B1:H1 | D1 | 70% | 1.50 |
| 36 | Application liquid 1 for first intermediate layer | 55 | 10 | A101 | B1:H1 | D1 | 90% | 1.50 |
| 37 | Application liquid 1 for first intermediate layer | 55 | 30 | A101 | B1:H4 | D1 | 41% | 0.50 |

TABLE 19-continued

| | First intermediate layer | | | Second intermediate layer | | | | |
|---|---|---|---|---|---|---|---|---|
| Example | Prepared liquid used for first intermediate layer | Metal oxide particle diameter | Thick-ness/ μm | Electron transport substance | Cross-linking agent | Resin | Content of electron transort substance | Thick-ness/ μm |
| 38 | Application liquid 1 for first intermediate layer | 55 | 30 | A101 | B1:H6 | D1 | 41% | 0.50 |
| 39 | Application liquid 1 for first intermediate layer | 55 | 30 | A101 | B4:H1 | D1 | 41% | 0.50 |
| 40 | Application liquid 1 for first intermediate layer | 55 | 30 | A101 | B8:H1 | — | 41% | 0.50 |
| 41 | Application liquid 1 for first intermediate layer | 55 | 30 | A101 | B1:H1 | — | 42% | 0.50 |
| 42 | Application liquid 1 for first intermediate layer | 55 | 30 | A101 | B1:H1 | — | 10% | 0.50 |
| 43 | Application liquid 1 for first intermediate layer | 55 | 30 | A101 | B1:H1 | — | 30% | 0.50 |
| 44 | Application liquid 1 for first intermediate layer | 55 | 30 | A101 | B1:H1 | — | 70% | 0.50 |
| 45 | Application liquid 1 for first intermediate layer | 55 | 30 | A101 | B1:H1 | — | 90% | 0.50 |
| 46 | Application liquid 1 for first intermediate layer | 55 | 30 | A101 | B1:H1 | — | 10% | 0.20 |
| 47 | Application liquid 1 for first intermediate layer | 55 | 30 | A101 | B1:H1 | — | 30% | 0.20 |
| 48 | Application liquid 1 for first intermediate layer | 55 | 10 | A101 | B1:H1 | — | 70% | 1.50 |
| 49 | Application liquid 1 for first intermediate layer | 55 | 10 | A101 | B1:H1 | — | 90% | 1.50 |

TABLE 20

| Example | Prepared liquid used for first intermediate layer | Metal oxide particle diameter | Thick-ness s/μm | Electron transport substance | Cross-linking agent | Resin | Content of electron transport polym-erized product | Ratio of electron transport substance | Thick-ness/ μm |
|---|---|---|---|---|---|---|---|---|---|
| 50 | Application liquid 1 for first intermediate layer | 55 | 30 | A117 | C1-3 | D1 | 71% | 42% | 0.50 |
| 51 | Application liquid 2 for first intermediate layer | 55 | 30 | A117 | C1-3 | D1 | 71% | 42% | 0.50 |
| 52 | Application liquid 3 for first intermediate layer | 55 | 30 | A117 | C1-3 | D1 | 71% | 42% | 0.50 |
| 53 | Application liquid 4 for first intermediate layer | 40 | 30 | A117 | C1-3 | D1 | 71% | 42% | 0.50 |
| 54 | Application liquid 5 for first intermediate layer | 260 | 30 | A117 | C1-3 | D1 | 71% | 42% | 0.50 |
| 55 | Application liquid 6 for first intermediate layer | 260 | 30 | A117 | C1-3 | D1 | 71% | 42% | 0.50 |
| 56 | Application liquid 7 for first intermediate layer | 400 | 30 | A117 | C1-3 | D1 | 71% | 42% | 0.50 |
| 57 | Application liquid 1 for first intermediate layer | 55 | 30 | A204 | C1-3 | D1 | 71% | 42% | 0.50 |
| 58 | Application liquid 1 for first intermediate layer | 55 | 30 | A304 | C1-3 | D1 | 71% | 42% | 0.50 |
| 59 | Application liquid 1 for first intermediate layer | 55 | 30 | A401 | C1-3 | D1 | 71% | 42% | 0.50 |
| 60 | Application liquid 1 for first intermediate layer | 55 | 30 | A508 | C1-3 | D1 | 71% | 42% | 0.50 |
| 61 | Application liquid 1 for first intermediate layer | 55 | 30 | A607 | C1-3 | D1 | 71% | 42% | 0.50 |
| 62 | Application liquid 1 for first intermediate layer | 55 | 30 | A702 | C1-3 | D1 | 71% | 42% | 0.50 |
| 63 | Application liquid 1 for first intermediate layer | 55 | 30 | A807 | C1-3 | D1 | 71% | 42% | 0.50 |
| 64 | Application liquid 1 for first intermediate layer | 55 | 30 | A909 | C1-3 | D1 | 71% | 42% | 0.50 |
| 65 | Application liquid 1 for first intermediate layer | 55 | 30 | A1002 | C1-3 | D1 | 71% | 42% | 0.50 |
| 66 | Application liquid 1 for first intermediate layer | 55 | 30 | A1101 | C1-3 | D1 | 71% | 42% | 0.50 |
| 67 | Application liquid 1 for first intermediate layer | 55 | 30 | A1205 | C1-3 | D1 | 71% | 42% | 0.50 |
| 68 | Application liquid 1 for first intermediate layer | 55 | 30 | A1309 | C1-3 | D1 | 71% | 42% | 0.50 |
| 69 | Application liquid 1 for first intermediate layer | 55 | 30 | A1409 | C1-3 | D1 | 71% | 42% | 0.50 |
| 70 | Application liquid 1 for first intermediate layer | 55 | 30 | A1502 | C1-3 | D1 | 71% | 42% | 0.50 |
| 71 | Application liquid 1 for first intermediate layer | 55 | 30 | A1608 | C1-3 | D1 | 71% | 42% | 0.50 |
| 72 | Application liquid 1 for first intermediate layer | 55 | 30 | A1712 | C1-3 | D1 | 71% | 42% | 0.50 |
| 73 | Application liquid 1 for first intermediate layer | 55 | 30 | A117 | C1-3 | D1 | 71% | 42% | 0.10 |
| 74 | Application liquid 1 for first intermediate layer | 55 | 30 | A117 | C1-3 | D1 | 71% | 42% | 0.20 |
| 75 | Application liquid 1 for first intermediate layer | 55 | 30 | A117 | C1-3 | D1 | 71% | 42% | 0.70 |
| 76 | Application liquid 1 for first intermediate layer | 55 | 30 | A117 | C1-3 | D1 | 71% | 42% | 1.00 |
| 77 | Application liquid 1 for first intermediate layer | 55 | 30 | A117 | C1-3 | D1 | 71% | 42% | 1.50 |
| 78 | Application liquid 1 for first intermediate layer | 55 | 30 | A117 | C1-3 | D1 | 71% | 42% | 0.05 |
| 79 | Application liquid 1 for first intermediate layer | 55 | 30 | A117 | C1-3 | D1 | 71% | 42% | 2.00 |
| 80 | Application liquid 1 for first intermediate layer | 55 | 30 | A117 | C1-3 | D1 | 71% | 42% | 2.50 |
| 81 | Application liquid 1 for first intermediate layer | 55 | 30 | A117 | C1-3 | D1 | 71% | 42% | 3.00 |
| 82 | Application liquid 1 for first intermediate layer | 55 | 30 | A117 | C1-3 | D1 | 71% | 10% | 0.20 |
| 83 | Application liquid 1 for first intermediate layer | 55 | 30 | A117 | C1-3 | D1 | 71% | 30% | 0.20 |
| 84 | Application liquid 1 for first intermediate layer | 55 | 30 | A117 | C1-3 | D1 | 71% | 50% | 0.20 |
| 85 | Application liquid 1 for first intermediate layer | 55 | 30 | A117 | C2-2 | D1 | 71% | 42% | 0.50 |
| 86 | Application liquid 1 for first intermediate layer | 55 | 30 | A117 | C3-2 | D1 | 71% | 42% | 0.50 |
| 87 | Application liquid 1 for first intermediate layer | 55 | 30 | A117 | C4-2 | D1 | 71% | 42% | 0.50 |
| 88 | Application liquid 1 for first intermediate layer | 55 | 30 | A117 | C5-3 | D1 | 71% | 42% | 0.50 |
| 89 | Application liquid 1 for first intermediate layer | 55 | 30 | A117 | C1-3 | — | 100.0 | 58% | 0.50 |
| 90 | Application liquid 1 for first intermediate layer | 55 | 30 | A117 | C1-3 | — | 100.0 | 10% | 0.50 |
| 91 | Application liquid 1 for first intermediate layer | 55 | 30 | A117 | C1-3 | — | 100.0 | 30% | 0.50 |
| 92 | Application liquid 1 for first intermediate layer | 55 | 30 | A117 | C1-3 | — | 100.0 | 70% | 0.50 |
| 93 | Application liquid 1 for first intermediate layer | 55 | 30 | A117 | C1-3 | — | 100.0 | 90% | 0.50 |
| 94 | Application liquid 1 for first intermediate layer | 55 | 30 | A117 | C1-3 | — | 100.0 | 10% | 0.20 |

TABLE 20-continued

| Example | Prepared liquid used for first intermediate layer | Metal oxide particle diameter | Thick-ness s/μm | Electron transport substance | Cross-linking agent | Resin | Content of electron transport polym-erized product | Ratio of electron transport substance | Thick-ness/ μm |
|---|---|---|---|---|---|---|---|---|---|
| 95 | Application liquid 1 for first intermediate layer | 55 | 30 | A117 | C1-3 | — | 100.0 | 30% | 0.20 |
| 96 | Application liquid 1 for first intermediate layer | 55 | 10 | A117 | C1-3 | — | 100.0 | 70% | 1.50 |
| 97 | Application liquid 1 for first intermediate layer | 55 | 10 | A117 | C1-3 | — | 100.0 | 90% | 1.50 |
| 98 | Application liquid 10 for first intermediate layer | 55 | 30 | A119 | B1:H1 | D1 | 96% | 41% | 0.50 |
| 99 | Application liquid 11 for first intermediate layer | 55 | 30 | A119 | B1:H1 | D1 | 96% | 41% | 0.50 |

TABLE 21

| Example | Content of electron transport substance with respect to metal oxide (mass %) | Content of electron transport substance and cross-linking agent with respect to metal oxide (mass %) | Evaluation | |
|---|---|---|---|---|
| | | | Voltage fluctu-ation (ΔV1) | Black spot |
| 1 | 0.93 | 2.20 | 5 | A |
| 2 | 0.93 | 2.20 | 7 | A |
| 3 | 0.93 | 2.20 | 6 | A |
| 4 | 0.93 | 2.20 | 10 | B |
| 5 | 0.93 | 2.20 | 8 | A |
| 6 | 0.93 | 2.20 | 10 | A |
| 7 | 0.93 | 2.20 | 8 | B |
| 8 | 0.93 | 2.20 | 9 | A |
| 9 | 0.93 | 2.20 | 5 | A |
| 10 | 0.93 | 2.20 | 8 | A |
| 11 | 0.93 | 2.20 | 6 | A |
| 12 | 0.93 | 2.20 | 13 | A |
| 13 | 0.93 | 2.20 | 8 | A |
| 14 | 0.93 | 2.20 | 7 | A |
| 15 | 0.93 | 2.20 | 7 | A |
| 16 | 0.93 | 2.20 | 6 | A |
| 17 | 0.93 | 2.20 | 7 | A |
| 18 | 0.93 | 2.20 | 12 | A |
| 19 | 0.93 | 2.20 | 11 | A |
| 20 | 0.93 | 2.20 | 10 | A |
| 21 | 0.93 | 2.20 | 13 | A |
| 22 | 0.93 | 2.20 | 12 | A |
| 23 | 0.93 | 2.20 | 11 | A |
| 24 | 0.19 | 0.44 | 21 | C |
| 25 | 0.37 | 0.88 | 10 | B |
| 26 | 1.30 | 3.08 | 8 | A |
| 27 | 1.85 | 4.40 | 11 | A |
| 28 | 2.78 | 6.60 | 12 | A |
| 29 | 0.09 | 0.22 | 25 | C |
| 30 | 3.71 | 8.80 | 13 | A |
| 31 | 4.63 | 11.00 | 14 | A |
| 32 | 5.56 | 13.21 | 15 | A |
| 33 | 0.09 | 0.88 | 23 | C |
| 34 | 0.27 | 0.88 | 10 | A |
| 35 | 14.38 | 19.81 | 14 | A |
| 36 | 18.49 | 19.81 | 22 | A |
| 37 | 0.93 | 2.20 | 7 | A |
| 38 | 0.93 | 2.20 | 5 | A |
| 39 | 0.93 | 2.20 | 5 | A |
| 40 | 0.93 | 2.20 | 7 | A |
| 41 | 0.93 | 2.28 | 5 | A |
| 42 | 0.23 | 2.28 | 14 | B |
| 43 | 0.68 | 2.28 | 7 | A |
| 44 | 1.60 | 2.28 | 7 | A |

TABLE 21-continued

| Example | Content of electron transport substance with respect to metal oxide (mass %) | Content of electron transport substance and cross-linking agent with respect to metal oxide (mass %) | Evaluation | |
|---|---|---|---|---|
| | | | Voltage fluctu-ation (ΔV1) | Black spot |
| 45 | 2.05 | 2.28 | 12 | A |
| 46 | 0.09 | 0.91 | 22 | C |
| 47 | 0.27 | 0.91 | 10 | A |
| 48 | 14.38 | 20.55 | 19 | A |
| 49 | 18.49 | 20.55 | 24 | A |
| 50 | 0.96 | 1.62 | 5 | A |
| 51 | 0.96 | 1.62 | 8 | A |
| 52 | 0.96 | 1.62 | 7 | A |
| 53 | 0.96 | 1.62 | 9 | B |
| 54 | 0.96 | 1.62 | 8 | A |
| 55 | 0.96 | 1.62 | 9 | A |
| 56 | 0.96 | 1.62 | 8 | B |
| 57 | 0.96 | 1.62 | 11 | A |
| 58 | 0.96 | 1.62 | 7 | A |
| 59 | 0.96 | 1.62 | 11 | A |
| 60 | 0.96 | 1.62 | 8 | A |
| 61 | 0.96 | 1.62 | 13 | A |
| 62 | 0.96 | 1.62 | 11 | A |
| 63 | 0.96 | 1.62 | 5 | A |
| 64 | 0.96 | 1.62 | 10 | A |
| 65 | 0.96 | 1.62 | 9 | A |
| 66 | 0.96 | 1.62 | 6 | A |
| 67 | 0.96 | 1.62 | 13 | A |
| 68 | 0.96 | 1.62 | 12 | A |
| 69 | 0.96 | 1.62 | 12 | A |
| 70 | 0.96 | 1.62 | 13 | A |
| 71 | 0.96 | 1.62 | 12 | A |
| 72 | 0.96 | 1.62 | 12 | A |
| 73 | 0.19 | 0.32 | 21 | C |
| 74 | 0.38 | 0.65 | 10 | A |
| 75 | 1.34 | 2.27 | 9 | A |
| 76 | 1.92 | 3.24 | 11 | A |
| 77 | 2.88 | 4.86 | 12 | A |
| 78 | 0.10 | 0.16 | 25 | C |
| 79 | 3.84 | 6.48 | 13 | A |
| 80 | 4.79 | 8.11 | 13 | A |
| 81 | 5.75 | 9.73 | 15 | A |
| 82 | 0.09 | 0.65 | 22 | C |
| 83 | 0.27 | 0.65 | 10 | A |
| 84 | 0.46 | 0.65 | 10 | A |
| 85 | 0.96 | 1.62 | 6 | A |
| 86 | 0.96 | 1.62 | 10 | A |
| 87 | 0.96 | 1.62 | 8 | A |
| 88 | 0.96 | 1.62 | 8 | A |

TABLE 21-continued

| Example | Content of electron transport substance with respect to metal oxide (mass %) | Content of electron transport substance and cross-linking agent with respect to metal oxide (mass %) | Evaluation | |
|---|---|---|---|---|
| | | | Voltage fluctu-ation (ΔV1) | Black spot |
| 89 | 1.32 | 2.28 | 5 | A |
| 90 | 0.23 | 2.28 | 14 | B |
| 91 | 0.68 | 2.28 | 7 | A |
| 92 | 1.60 | 2.28 | 8 | A |
| 93 | 2.05 | 2.28 | 13 | A |
| 94 | 0.09 | 0.91 | 21 | C |
| 95 | 0.27 | 0.91 | 10 | B |
| 96 | 14.38 | 20.55 | 17 | A |
| 97 | 18.49 | 20.55 | 24 | A |
| 98 | 0.76 | 1.81 | 6 | A |
| 99 | 0.76 | 1.81 | 8 | A |

TABLE 22

| Comparative Example | Evaluation | |
|---|---|---|
| | Voltage fluctuation | Black spot |
| 1 | 26 | D |
| 2 | 13 | E |
| 3 | 26 | C |
| 4 | 34 | D |
| 5 | 33 | C |
| 6 | 35 | D |
| 7 | 31 | C |
| 8 | 45 | C |
| 9 | 60 | E |

Comparison between Examples and Comparative Example 1 has shown that when the number-average primary particle diameter of the metal oxide in the first intermediate layer is small, sufficient suppressing effects may not be obtained on a voltage fluctuation and a black spot in a high-temperature and high-humidity environment. This is probably because when the number-average primary particle diameter of the metal oxide particles is small, the oxygen deficiency concentration of the metal oxide per unit mass increases, and hence the voltage fluctuation of an exposed portion is liable to occur owing to repeated use under the high-temperature and high-humidity environment.

Comparison between Examples and Comparative Example 2 has shown that when the number-average primary particle diameter of the metal oxide in the first intermediate layer is large, a sufficient suppressing effect may not be obtained on a black spot. This is probably because when the number-average primary particle diameter of the metal oxide is large, a local conductive path is liable to be formed and hence the black spot is liable to occur.

Comparison between Examples and Comparative Example 3 has shown that when the electron-nonlocalized site of the electron transport substance and the bonding site of the crosslinking agent are distant from each other, a sufficient suppressing effect may not be obtained on a voltage fluctuation in a high-temperature and high-humidity environment.

Comparison between Examples and Comparative Example 4 has shown that sufficient suppressing effects may not be obtained on a voltage fluctuation and a black spot in a high-temperature and high-humidity environment depending on the structure of the polymerizable functional group portion of the electron transport substance. This is probably because the uniformity of the electron transport substance in the film is liable to reduce depending on the structure of the polymerizable functional group.

Comparison between Examples and Comparative Examples 5 to 8 has shown that a sufficient suppressing effect may not be obtained on a voltage fluctuation in a high-temperature and high-humidity environment depending on the molecular weights of the electron transport substance and the crosslinking agent.

This is probably because when the molecular weights of the electron transport substance and the crosslinking agent do not fall within proper ranges, a uniform three-dimensional crosslinked structure is hardly formed between the electron transport substance and the crosslinking agent.

Comparison between Examples and Comparative Example 9 has shown that when the second intermediate layer is free of any electron transport substance, sufficient suppressing effects may not be obtained on a voltage fluctuation and a black spot in a high-temperature and high-humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270565, filed Dec. 26, 2013, and Japanese Patent Application No. 2014-245137, filed Dec. 3, 2014, which are hereby incorporated by reference herein in their entirety.

What is claimed is:

1. An electrophotographic photosensitive member, comprising:

a support;

a first intermediate layer on the support;

a second intermediate layer on the first intermediate layer; and a photosensitive layer on the second intermediate layer, wherein:

the first intermediate layer comprises metal oxide particles having a number-average primary particle diameter of 30 nm or more and 450 nm or less; and the second intermediate layer comprises a polymerized product of a composition comprising:

an electron transport substance having a polymerizable functional group represented by the following formula (1) or (2), and having a molecular weight of 100 or more and 1,000 or less, and a crosslinking agent having 3 to 6 groups reactive with the polymerizable functional group represented by the following formula (1) or (2), and having a molecular weight of 200 or more and 1,300 or less:

$$-A \quad (1)$$

$$-(-B-)_1C-D \quad (2)$$

in the formulae (1) and (2):

at least one of A, B, C, and D represents a group having a polymerizable functional group, the polymerizable functional group is at least one kind of group selected from the group consisting of a hydroxy group, a thiol group, an amino group, and a carboxyl group, and l represents 0 or 1;

A represents a carboxyl group, a substituted or unsubstituted alkyl group having 1 to 6 main-chain atoms, a group having 1 to 6 main-chain atoms derived by substituting one of carbon atoms in a main chain of the substituted or unsubstituted alkyl group with an oxygen atom, a group having 1 to 6 main-chain atoms derived by substituting one of the carbon atoms in the main chain of the substituted or unsubstituted alkyl group with a sulfur atom, or a group having 1 to 6 main-chain atoms derived by substituting one of the carbon atoms in the main chain of the substituted or unsubstituted alkyl group with $NR^1$, these groups each have the polymerizable functional group, $R^1$ represents a hydrogen atom or an alkyl group, and a substituent of the substituted alkyl group is an alkyl group having 1 to 6 carbon atoms, a benzyl group, or a phenyl group;

B represents a substituted or unsubstituted alkylene group having 1 to 6 main-chain atoms, a group having 1 to 6 main-chain atoms derived by substituting one of carbon atoms in a main chain of the substituted or unsubstituted alkylene group with an oxygen atom, a group having 1 to 6 main-chain atoms derived by substituting one of the carbon atoms in the main chain of the substituted or unsubstituted alkylene group with a sulfur atom, or a group having 1 to 6 main-chain atoms derived by substituting one of the carbon atoms in the main chain of the substituted or unsubstituted alkylene group with $NR^2$, these groups may each have the polymerizable functional group, $R^2$ represents a hydrogen atom or an alkyl group, and a substituent of the substituted alkylene group is an alkyl group having 1 to 6 carbon atoms, a benzyl group, an alkoxycarbonyl group, or a phenyl group;

C represents a phenylene group, a phenylene group substituted with an alkyl group having 1 to 6 carbon atoms, a nitro-substituted phenylene group, a halogen-substituted phenylene group, or an alkoxy group-substituted phenylene group, and these groups may each have the polymerizable functional group; and D represents a hydrogen atom, an alkyl group having 1 to 6 carbon atoms, or an alkyl group having 1 to 6 main-chain atoms substituted with an alkyl group having 1 to 6 carbon atoms, and these groups may each have the polymerizable functional group.

2. An electrophotographic photosensitive member according to claim 1, wherein a content of the electron transport substance in the composition of the second intermediate layer with respect to the metal oxide particles of the first intermediate layer is 0.2 mass % or more and 15 mass % or less.

3. An electrophotographic photosensitive member according to claim 1, wherein a total content of the electron transport substance and the crosslinking agent in the composition of the second intermediate layer with respect to the metal oxide particles of the first intermediate layer is 0.5 mass % or more and 20 mass % or less.

4. An electrophotographic photosensitive member according to claim 1, wherein the crosslinking agent is one of an isocyanate compound having one of an isocyanate group and a blocked isocyanate group, and an amine compound having one of an N-methylol group and an alkyl-etherified N-methylol group.

5. An electrophotographic photosensitive member according to claim 1, wherein the composition of the second intermediate layer further comprises a thermoplastic resin having a polymerizable functional group.

6. An electrophotographic photosensitive member according to claim 5, wherein the polymerizable functional group of the thermoplastic resin is one of a hydroxy group, a thiol group, an amino group, a carboxyl group, and a methoxy group.

7. An electrophotographic photosensitive member according to claim 1, wherein the metal oxide particles is one of titanium oxide particles and zinc oxide particles.

8. A method of producing an electrophotographic photosensitive member comprising: a support; a first intermediate layer on the support; a second intermediate layer on the first intermediate layer; and a photosensitive layer on the second intermediate layer, the method comprising:

forming a coat of an application liquid for a first intermediate layer that comprises metal oxide particles having a number-average primary particle diameter of 30 nm or more and 450 nm or less;

heating the coat to form the first intermediate layer;

forming a coat of an application liquid for a second intermediate layer that comprises a composition comprising an electron transport substance having a polymerizable functional group represented by the following formula (1) or (2), and having a molecular weight of 100 or more and 1,000 or less, and a crosslinking agent having 3 to 6 groups reactive with the polymerizable functional group represented by the following formula (1) or (2), and having a molecular weight of 200 or more and 1,300 or less; and heating and curing the coat to form the second intermediate layer:

$$-A \quad (1)$$

$$-(-B-)_l C-D \quad (2)$$

in the formulae (1) and (2):

at least one of A, B, C, and D represents a group having a polymerizable functional group, the polymerizable functional group is at least one kind of group selected from the group consisting of a hydroxy group, a thiol group, an amino group, and a carboxyl group, and l represents 0 or 1;

A represents a carboxyl group, a substituted or unsubstituted alkyl group having 1 to 6 main-chain atoms, a group having 1 to 6 main-chain atoms derived by substituting one of carbon atoms in a main chain of the substituted or unsubstituted alkyl group with an oxygen atom, a group having 1 to 6 main-chain atoms derived by substituting one of the carbon atoms in the main chain of the substituted or unsubstituted alkyl group with a sulfur atom, or a group having 1 to 6 main-chain atoms derived by substituting one of the carbon atoms in the main chain of the substituted or unsubstituted alkyl group with $NR^1$, these groups each have the polymerizable functional group, $R^1$ represents a hydrogen atom or an alkyl group, and a substituent of the substituted alkyl group is an alkyl group having 1 to 6 carbon atoms, a benzyl group, or a phenyl group;

B represents a substituted or unsubstituted alkylene group having 1 to 6 main-chain atoms, a group having 1 to 6 main-chain atoms derived by substituting one of carbon atoms in a main chain of the substituted or unsubstituted alkylene group with an oxygen atom, a group having 1 to 6 main-chain atoms derived by substituting one of the carbon atoms in the main chain of the substituted or unsubstituted alkylene group with a sulfur atom, or a group having 1 to 6 main-chain atoms derived by substituting one of the carbon atoms in the main chain of the substituted or unsubstituted alkylene group with $NR^2$, these groups may each have the polymerizable functional group, $R^2$ represents a hydrogen atom or an alkyl group, and a substituent of the substituted alkylene group is an alkyl group having 1 to 6 carbon atoms, a benzyl group, an alkoxycarbonyl group, or a phenyl group;

C represents a phenylene group, a phenylene group substituted with an alkyl group having 1 to 6 carbon atoms, a nitro-substituted phenylene group, a halogen-substituted phenylene group, or an alkoxy group-substituted phenylene group, and these groups may each have the polymerizable functional group; and D represents a hydrogen atom, an alkyl group having 1 to 6 carbon atoms, or an alkyl group having 1 to 6 main-chain atoms substituted with an alkyl group having 1 to 6 carbon atoms, and these groups may each have the polymerizable functional group.

9. A process cartridge, comprising:

the electrophotographic photosensitive member according to claim 1; and at least one unit selected from the group consisting of a charging unit, a developing unit, and a cleaning unit, the process cartridge integrally supporting the electrophotographic photosensitive member and the at least one unit, the process cartridge being removably mounted onto a main body of an electrophotographic apparatus.

10. An electrophotographic apparatus, comprising:

the electrophotographic photosensitive member according to claim 1;

a charging unit;

an exposing unit;

a developing unit; and a transferring unit.

* * * * *